US011208241B1

(12) United States Patent
Gillman

(10) Patent No.: US 11,208,241 B1
(45) Date of Patent: Dec. 28, 2021

(54) DISPENSING CAP

(71) Applicant: Kenpac, LLC, Palm Beach Gardens, FL (US)

(72) Inventor: Kenneth Gillman, Palm Beach Gardens, FL (US)

(73) Assignee: Kenpac, LLC, Palm Beach Gardens, FL (US)

( * ) Notice: Subject to any disclaimer, the term of this patent is extended or adjusted under 35 U.S.C. 154(b) by 8 days.

(21) Appl. No.: 16/935,405

(22) Filed: Jul. 22, 2020

(51) Int. Cl.

| | |
|---|---|
| ***B65D 50/04*** | (2006.01) |
| ***B65D 47/08*** | (2006.01) |
| ***B65D 51/24*** | (2006.01) |
| ***A61J 1/03*** | (2006.01) |

(52) U.S. Cl.
CPC ..... *B65D 50/041* (2013.01); *A61J 1/03* (2013.01); *B65D 47/0823* (2013.01); *B65D 51/245* (2013.01)

(58) Field of Classification Search
CPC ..... B65D 50/041; B65D 2215/02; B65D 2215/04; B65D 50/02; B65D 2215/00; B65D 47/261; B65D 47/263; B65D 47/0874; B65D 47/0804; B65D 47/0809; B65D 47/0838; B65D 43/18; B65D 39/02; B65D 55/16; B65D 2251/1058
USPC ..... 215/243, 237, 235, 318, 206; 220/253; 222/49, 47, 46, 23
See application file for complete search history.

(56) References Cited

U.S. PATENT DOCUMENTS

| | | | | |
|---|---|---|---|---|
| 4,513,888 | A * | 4/1985 | Curry | B65D 47/0819 215/213 |
| 5,348,201 | A | 9/1994 | Koo | |
| 6,095,354 | A | 8/2000 | Herr et al. | |
| 7,404,495 | B2 | 7/2008 | Keung | |
| 7,621,413 | B2 * | 11/2009 | Miota | B65B 7/285 215/329 |
| 7,861,873 | B1 | 1/2011 | Bragg et al. | |
| 8,474,634 | B1 * | 7/2013 | Branson | B65D 50/041 215/220 |
| 9,102,449 | B2 | 8/2015 | Gatton et al. | |

(Continued)

FOREIGN PATENT DOCUMENTS

| | | |
|---|---|---|
| EP | 3260390 A1 | 12/2017 |
| WO | 9729971 | 8/1997 |

*Primary Examiner* — Anthony D Stashick
*Assistant Examiner* — Prince Pal
(74) *Attorney, Agent, or Firm* — Heslin Rothenberg Farley & Mesiti P.C.

(57) ABSTRACT

A child resistant dispensing cap including an inner cover and an outer ring. The inner cover being coaxially nested and retained within the outer ring. The outer ring configured to rotate around the inner cover. The inner cover and the outer ring may be manipulated relative to each other to be in a number of different configurations, including a locked position, an unlocked position and an open position. The inner cover including a lid pivotably mounted to the inner cover from a closed position to an open position. The lid including a free end. The outer ring including a front tab capable of flexing radially inward towards the inner cover. The dispensing cap configured in the unlocked position capable of flipping up the lid when the free end of the lid aligns with the front tab of the outer ring. When the front tab is pushed radially inward, an underside surface at the free end of the lid is exposed to allow the lid to pivot to the open position.

16 Claims, 22 Drawing Sheets

(56) References Cited

U.S. PATENT DOCUMENTS

| | | | | |
|---|---|---|---|---|
| 10,689,169 | B1 * | 6/2020 | Meshberg | B65D 50/046 |
| 2007/0199912 | A1 | 8/2007 | Libohova et al. | |
| 2010/0147732 | A1 * | 6/2010 | Delagrange | B65D 47/0804 206/528 |
| 2013/0175271 | A1 * | 7/2013 | Lim | B65D 47/0828 220/254.5 |
| 2015/0129531 | A1 * | 5/2015 | Gatton | B65D 50/061 215/201 |
| 2015/0344193 | A1 * | 12/2015 | Piscopo | B65D 50/041 53/492 |
| 2016/0159533 | A1 * | 6/2016 | Piscopo | B65D 50/041 53/490 |
| 2016/0280429 | A1 * | 9/2016 | Piscopo | B65D 50/046 |
| 2017/0035649 | A1 | 2/2017 | Balakier et al. | |
| 2017/0139216 | A1 * | 5/2017 | Crenko | G02B 27/02 |
| 2018/0273261 | A1 | 9/2018 | Qiu | |
| 2018/0319556 | A1 * | 11/2018 | Straughan | B65D 50/061 |
| 2018/0327174 | A1 * | 11/2018 | Daniels, Jr | A61J 1/03 |
| 2021/0031990 | A1 * | 2/2021 | Werp, II | B65D 50/048 |

* cited by examiner

DISPENSING CAP

BACKGROUND OF THE INVENTION

Technical Field

The present invention generally relates to container caps and, more particularly, a cap for use on, for example, a container capable of dispensing liquids, powders and solids including, for example, capsules, caplets, tablets and gel caps.

Background Information

Safety or child resistant caps are used to reduce the risk of children accessing and ingesting dangerous or toxic items. Prior attempts at designing and engineering a safety or child resistant cap for dispensing items are either insufficiently childproof or too difficult for an older adult to open. For example, existing child resistant closures require a simultaneous push and turn manipulation with one hand holding the container and the other hand pushing down on the closure while turning the closure in the counterclockwise or unscrewing direction. Another example requires holding the container in one hand and with the other squeezing the skirt from the oppose sides and simultaneously unscrewing the closure from the container.

These prior examples do not, however, provide an adequate child resistant design to a flip top closure. Generally, the common flip top dispensing caps used for tablets, such as vitamins or drugs, use a screw on non-resistant cap. However, those type of caps can only be used on products that do not require a child resistant feature. Prior attempts to design and engineer a child resistant dispensing cap having a flip top closure have resulted in complicated designs that are very expensive to manufacture.

There is, therefore, a need for an efficiently designed child resistant flip top dispensing closure.

SUMMARY OF THE INVENTION

The shortcomings of the prior art are overcome, and additional advantages are provided, through use of a dispensing cap constructed in accordance with one or more aspects of the present invention. A dispensing cap constructed in accordance with one or more aspects of the present invention may be used with any type of dispending container, for example, but not limited to, liquids, powders and solids, including, but not limited to, capsules, tablets, caplets, and gel caps. Additionally, other uses may be made of the invention that fall within the scope of the claimed invention but are not specifically described below.

In one aspect of the invention, there is provided a dispensing cap an inner cover and an outer ring. The inner cover includes a base and a lid. The base includes a sidewall and a deck extending radially inward from the sidewall. The deck includes a dispensing opening. The lid is hinged at a hinge end to the deck for pivotal movement between a closed position covering the dispensing opening and an open position spaced from the dispensing opening. The lid includes a finger tab portion end opposed to the hinge end. The finger tab portion end includes an underside surface. The inner cover is coaxially nested and retained within the outer ring. The outer ring includes a sidewall and a peripheral skirt extending radially inward from the sidewall. The peripheral skirt at least partially covers a portion of the deck of the inner cover. The sidewall of the inner cover faces the side wall of the inner cover. The sidewall of the outer ring includes an opening. A front tab resiliently extends from a peripheral of the sidewall in the opening. The front tab being directly manually engageable by a user from a radial direction external to the outer ring to pivot the front tab radially inward towards the sidewall of the base of the inner cover.

The outer ring is rotatable around the inner cover between an unlocked position when the front tab of the outer ring aligns with the finger tab portion end of the inner cover and a locked position when the finger tab portion of the inner cover does not align with the front tab of the outer ring. The lid is permitted to pivot to the open position when the outer ring and the inner cover are in the unlocked position and front tab pivots radially inward towards the sidewall of the base of the inner cover exposing the underside surface of the finger tab portion end of the lid of the inner cover. The lid is prevented from pivoting to the open position when the outer ring and the inner cover are in the locked position.

These, and other objects, features and advantages of this invention will become apparent from the following detailed description of the various aspects of the invention taken in conjunction with the accompanying drawings.

BRIEF DESCRIPTION OF THE DRAWINGS

The present invention will be understood more fully from the detailed description given hereinafter and from the accompanying drawings of the certain embodiments of the present invention, which, however, should not be taken to limit the invention, but are for explanation, illustration and understanding only.

DETAILED DESCRIPTION OF THE INVENTION

Figure 1A:
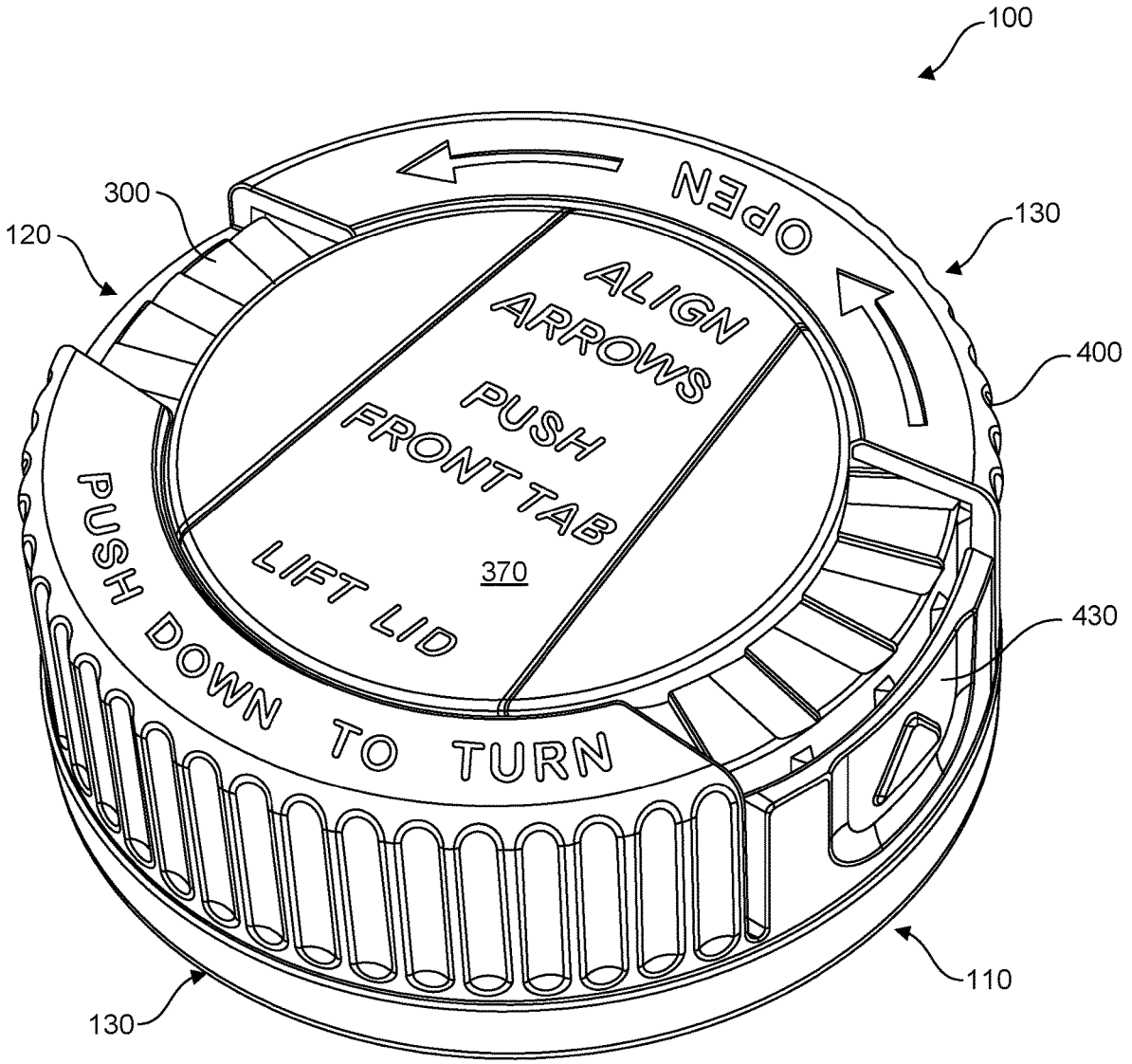
FIG. 1A depicts a perspective view of a dispensing cap constructed in accordance with one or more aspects of the present invention shown in a locked position.

The present invention will be discussed hereinafter in detail in terms of various exemplary embodiments according to the present invention with reference to the accompanying drawings. In the following detailed description, numerous specific details are set forth in order to provide a thorough understanding of the present invention. It will be obvious, however, to those skilled in the art that the present invention may be practiced without some of these specific details. In other instances, well-known structures are not shown in detail in order to avoid unnecessary obscuring of the present invention.

Thus, all implementations described below are exemplary implementations provided to enable persons skilled in the art to make or use the embodiments of the disclosure and are not intended to limit the scope of the disclosure, which is defined by the claims. As used herein, the word "exemplary" or "illustrative" or "example", and derivatives thereof, means "serving as an example, instance, or illustration." Any implementation described herein as "exemplary" or "illustrative" or "example", and derivatives thereof, is not necessarily and should not be construed as preferred or advantageous over other implementations. Moreover, in the present description, the terms "upper", "lower", "left", "rear", "right", "front", "vertical", "horizontal", and derivatives thereof shall relate to the invention as oriented in FIGS. 1A-1C.

Furthermore, there is no intention to be bound by any expressed or implied theory presented in the preceding technical field, background, brief summary or the following detailed description. It is also understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. While this invention is satisfied by embodiments in many different forms, there is shown in the drawings, and will herein be described in detail, one or more embodiments of the present invention with the understanding that the present disclosure is to be considered as exemplary of the principles and aspects of the invention and is not intended to limit the invention to the embodiments illustrated. The scope of the invention will be pointed out in the appended claims.

In short, a dispensing cap constructed in accordance with one or more aspects of the present invention provides a dispensing cap that is removably securable to a container. In one aspect, the dispensing cap is a two-piece cap, including an inner cover with a flip up lid and an outer ring. The combination and manipulation of the inner cover and the outer ring provide several child resistant features and restraints that prevent access to the contents of a container to which the dispensing cap is affixed. For example, the outer ring assembled to the inner cover is a child resistant feature when removing the dispensing cap from a container. In one embodiment, the inner cover is coaxially retained within the outer ring. The outer ring is rotatable around the inner cover between a locked position and an unlocked position. In the locked position, the lid is prevented from being flipped up. In one example, the outer ring and the inner cover will move together to screw off a container when downward pressure is applied to the outer ring and turned in a counterclockwise direction. This is one aspect rendering the removal of the dispensing cap child resistant. These and other features of a dispensing cap constructed in accordance with one or more aspects of the present invention will be described in more detail below.

Figure 1B:
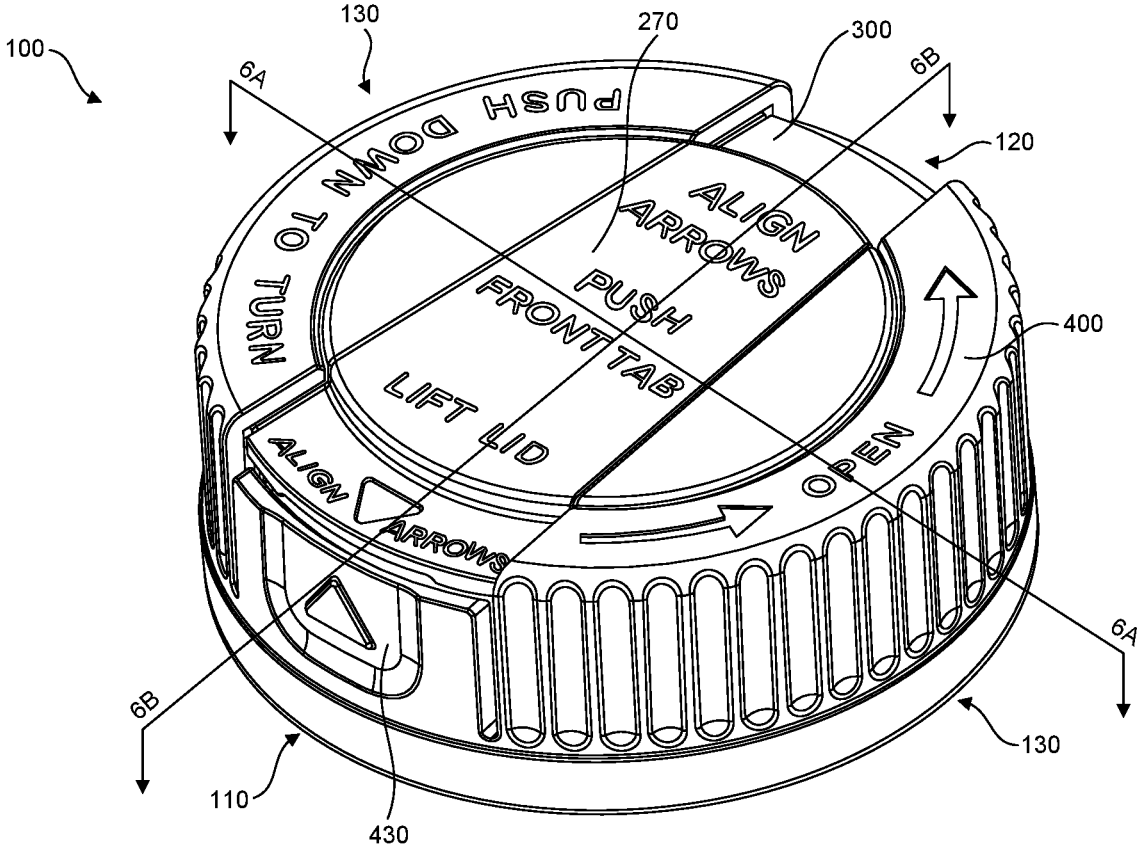
FIG. 1B depicts a perspective view of the dispensing cap illustrated in FIG. 1A shown in an unlocked position.
Figure 1C:
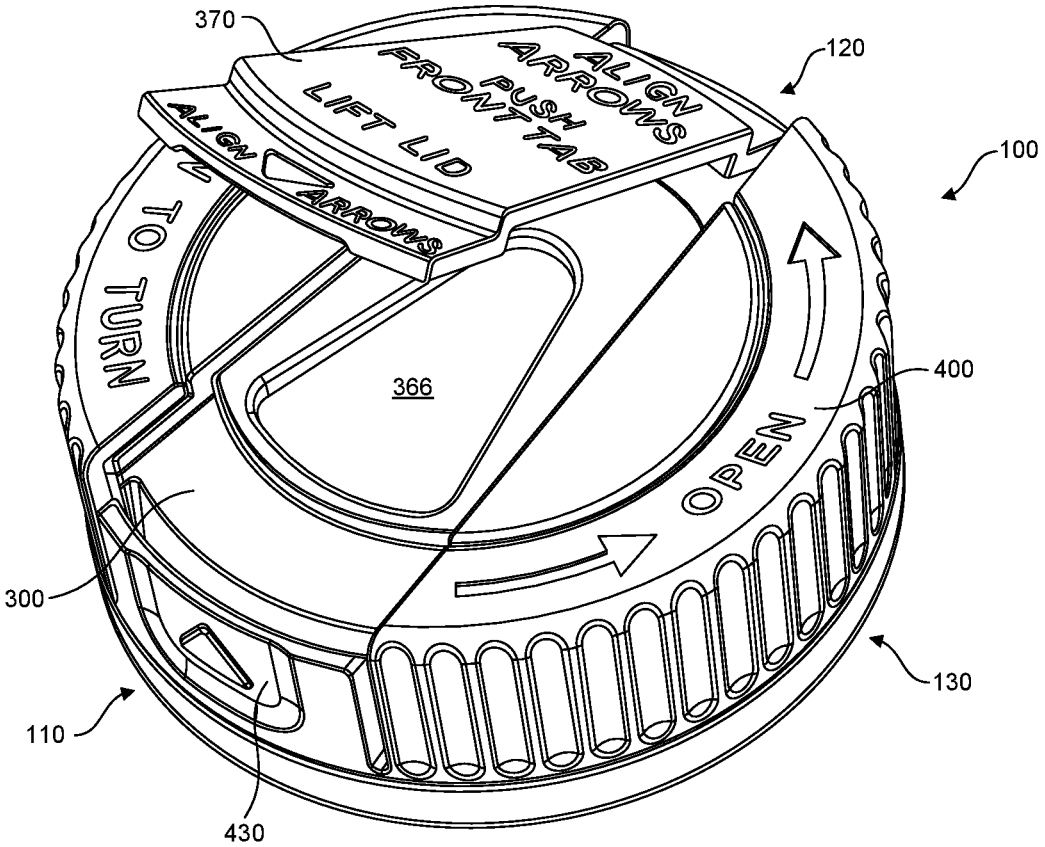
FIG. 1C depicts a perspective view of the dispensing cap illustrated in FIGS. 1A and 1B shown in an open or dispensing position
Figure 2:
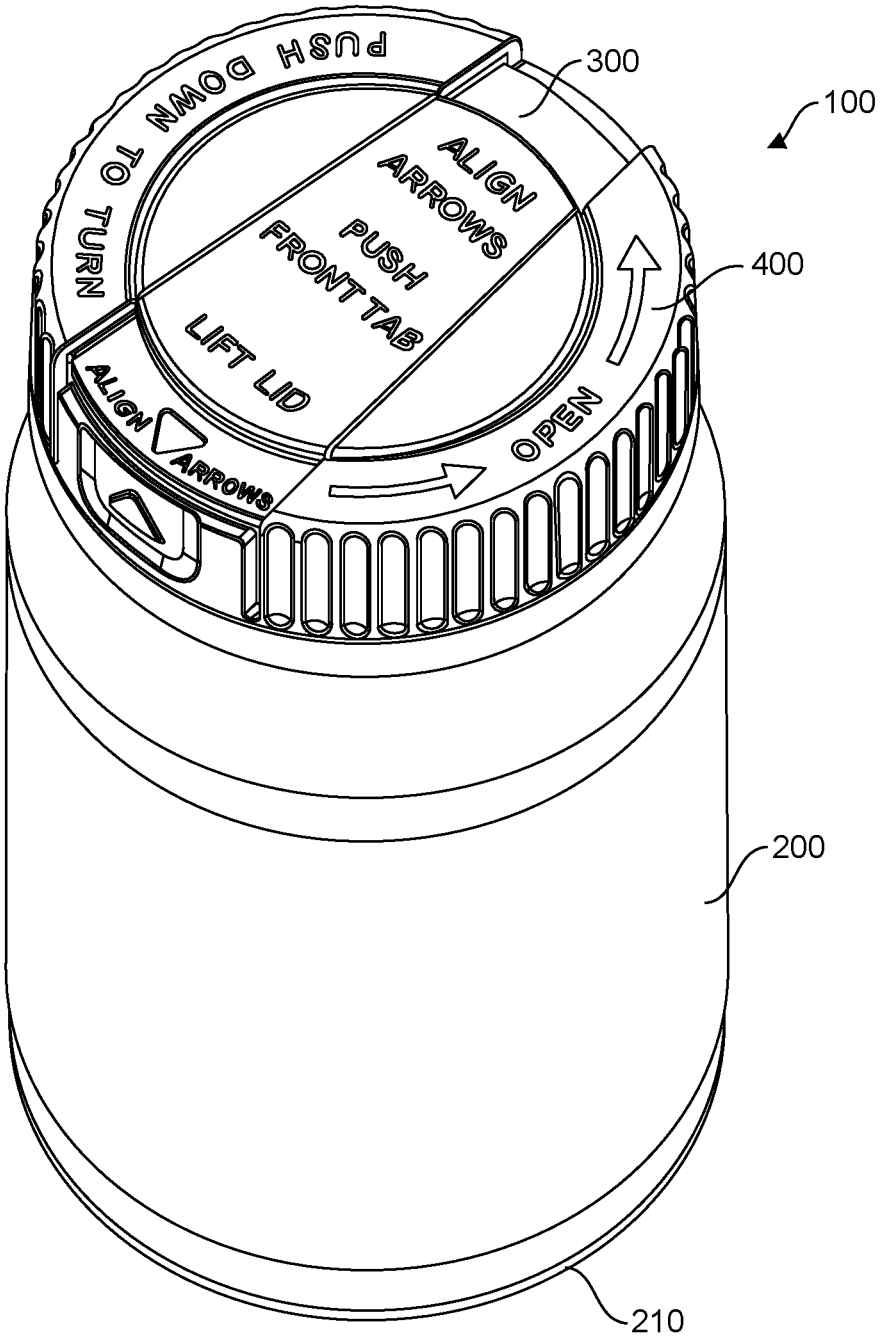
FIG. 2 depicts a perspective view of a dispensing cap constructed in accordance with one or more aspects of the present invention shown coupled to a container and in an open or dispensing position.

Referring now to FIGS. 1A-1C, there is shown various views of a dispensing cap 100 constructed in accordance with one or more aspect of the present invention. Dispensing cap 100 may be removably securable to a container 200, as illustrated in FIG. 2. Container 200 may be, for example, a conventional prescription vial for holding loose content such as pills. In one example, container 200 includes a bottom wall 210 that is substantially perpendicular to a longitudinal axis 202 and cylindrical sidewall 220 extending upwardly from bottom wall 210. Sidewall 220 terminates in an open end 230 and includes neck 240. Neck 240 may include an outer surface 242 having a plurality of threads 244 that mate with inner threads provided on dispensing cap 100 to screw dispensing cap 100 onto container 200. Instead of mating threads, alternative circumferential or annular locking elements such as, for example, locking projections, indentations, push and turn bodynet lugs or any other suitable type of external surface manifestations may be used to removeably retain or secure dispensing cap 100 to container 200. In other embodiments, dispensing cap 100 may be coupled to container 200 in any known and desired removable child resistant manner.

In one embodiment, container 200 may include a safety seal covering the open end 230 after initial filling of container 200 from, for example, the factory. In one aspect, dispensing cap 100 may be sized to accommodate this safety seal under, for example, inner cover 300. The dispensing cap 100 could then be initially removed to break or remove the safety seal for future use.

As illustrated in FIGS. 1A-1C, dispensing cap 100 includes a front portion 110, a back portion 120 diametrically opposed to front portion 110, and diametrically opposed side portions 130. Dispensing cap 100 also includes an inner cover 300 and an outer ring 400. Inner cover 300 is coaxially nested within outer ring 400. As described in more detail below, inner cover 300 and outer ring 400 may be manipulated relative to each other to be in a number of different configurations, including a locked position (see FIG. 1A), an unlocked position (see FIG. 1B) and an open position (see FIG. 1C).

FIGS. 3A-3G illustrate one example of an inner cover 300 constructed in accordance with one or more aspects of the present invention. Inner cover 300 is a dispensing cover that is coupled to container 200 in any suitable manner. For example, inner cover 300 may be screwed to container 200 by mating threads 244, 329, respectively, formed on the outer surface 242 of neck 240 of container 200 and on inner surface 328 of sidewall 322 of inner cover 300 (see e.g. FIGS. 6A and 6B).

In one embodiment, inner cover 300 includes a longitudinal axis 302, a front portion 304, a back portion 306 diametrically opposed to front portion 304, and diametrically opposed side portions 308. Inner cover 300 also includes a base 320 and a lid 370. Lid 370 may be pivotably coupled to base by, for example, a hinge 310. In one example, lid 370 may be a flip-top type of lid to allow dispensing of product out of open end 230 of container 200.

Base 320 of inner cover 300 may include a sidewall 322 and a deck 342. Deck 342 extends radially inward from a top end 324 of sidewall 322 and transversely to longitudinal axis 302. Deck 342 may include a top surface 344 (see e.g. FIG. 3A), a bottom surface 364 (see e.g. FIG. 3G) and a dispensing opening 366 (see e.g. FIG. 3B). In one embodiment, a portion of bottom surface 364 of deck 342 may form a seal with open end 230 of container 200 when secured together.

Figure 3A:
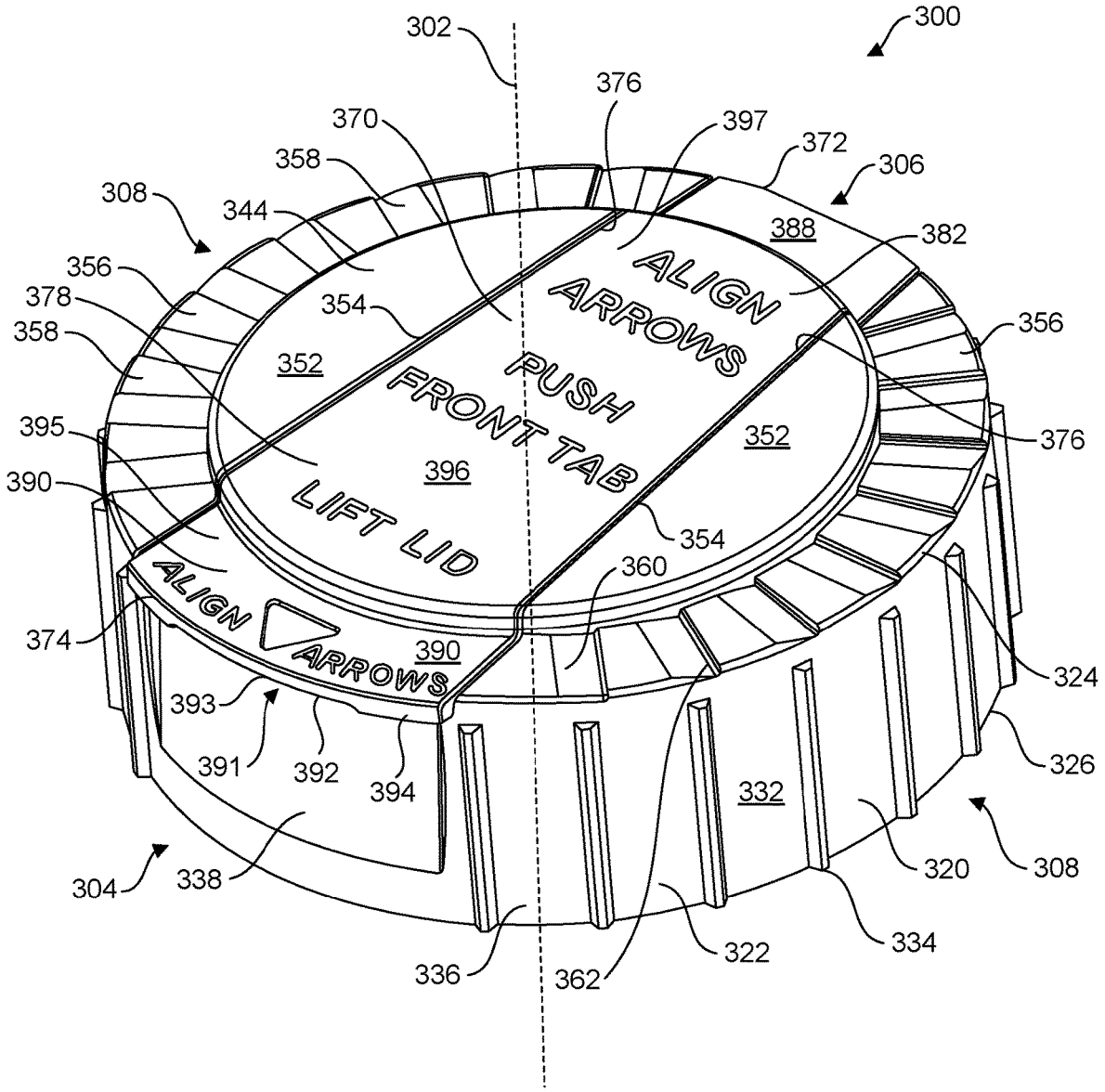
FIG. 3A depicts a perspective view from the top of an inner cover constructed in accordance with one or more aspects of the present invention illustrating one example of a lid in closed position.
Figure 3B:
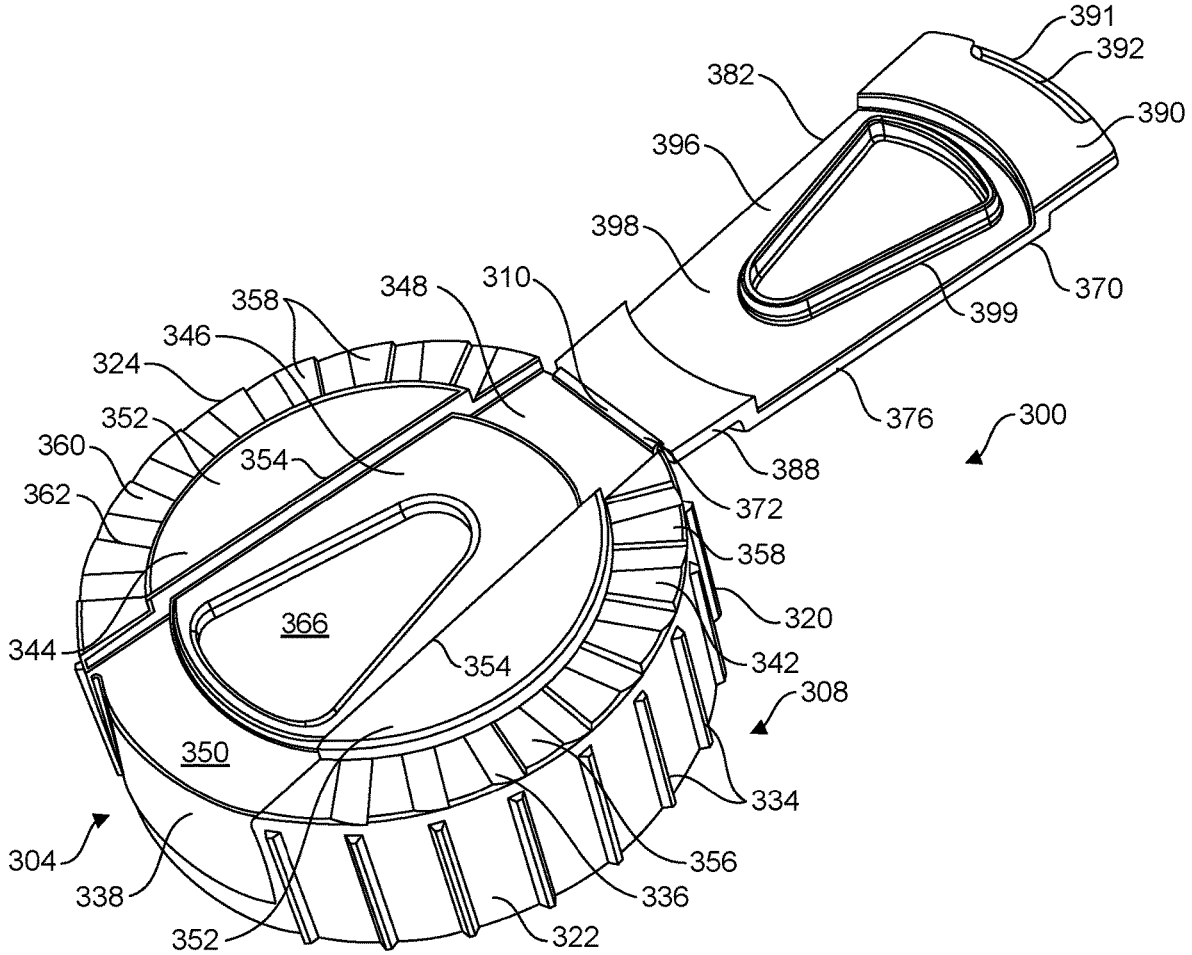
FIG. 3B depicts a perspective view from the top of the inner cover shown in FIG. 3A illustrating one example of a lid in an open position.
Figure 3C:
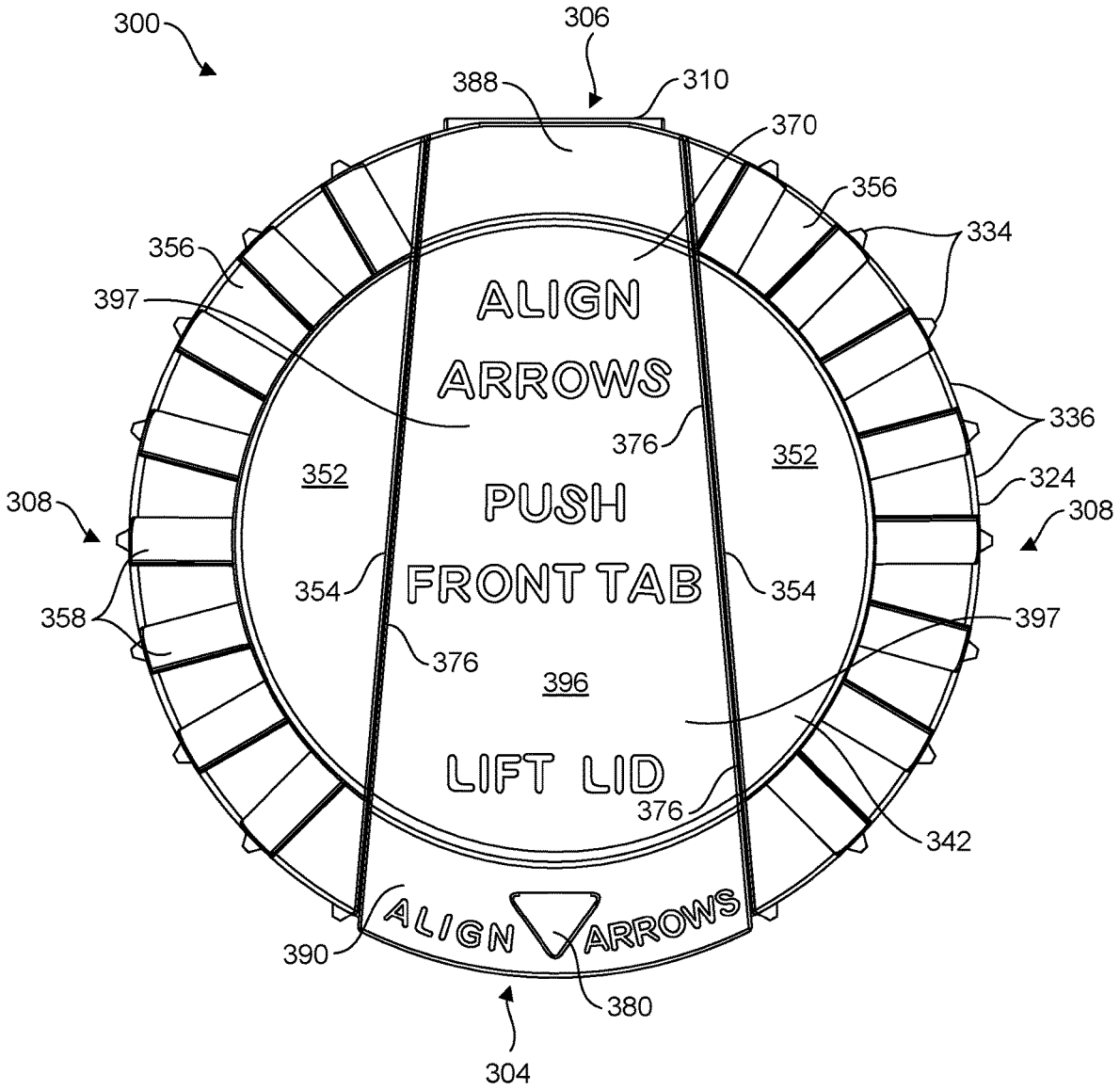
FIG. 3C depicts a top view of the inner cover illustrated in FIG. 3A.

As illustrated in FIG. 3B, top surface 344 of deck 342 may include a recessed portion 346. In one example, recessed portion 346 may extend from front portion 304 to back portion 306. Deck recessed portion 346 is configured and sized to receive and accommodate lid 370 in a closed position in accordance with one or more aspects of the present invention.

As illustrated in FIG. 3A, top surface 344 of deck 342 may also include two inner semi-circular surfaces 352 and two curved edge surfaces 356. Each inner semi-circular surface 352 may be disposed between a curved edge surface 356 and a flat side 347 of recessed portion 346. Flat sides 354 of two inner semi-circular surfaces 352 border a respective side 376 of lid 370 in a closed position (see e.g. FIG. 3C). Two curved edge surfaces 356 extend radially inwardly from the peripheral of deck 352 on side portions 308 of inner cover 300 and circumferentially from front portion 304 to back portion 306 alongside side portions 308. In one example, inner semi-circular surfaces 352 lie in a different plane transverse to longitudinal axis 302 than two curved edge surfaces 356.

In one embodiment, a plurality of circumferentially spaced ratchet depressions 358 may be formed in curved edge surfaces 356. Each depression 358 may be formed by an inclined surface 360 and a stop surface 362 (see e.g. FIG. 3B). In one example illustrated in FIG. 3B, inclined surface 360 angles inward from curved edge surface 356 in a counterclockwise direction to create a ramp towards stop surface 362. Stop surface 362 extends perpendicularly inward from semi-circular edge surface 356 and substantially transverse to longitudinal axis 302.

Figure 3D:
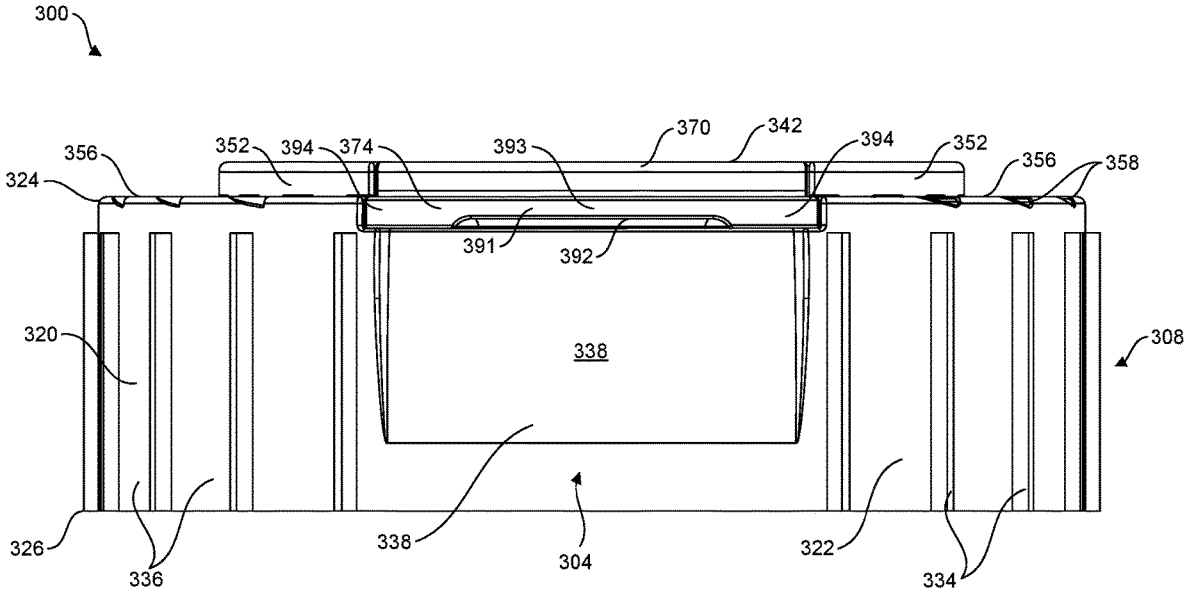
FIG. 3D depicts a front view of the outer ring illustrated in FIG. 3A.
Figure 3E:
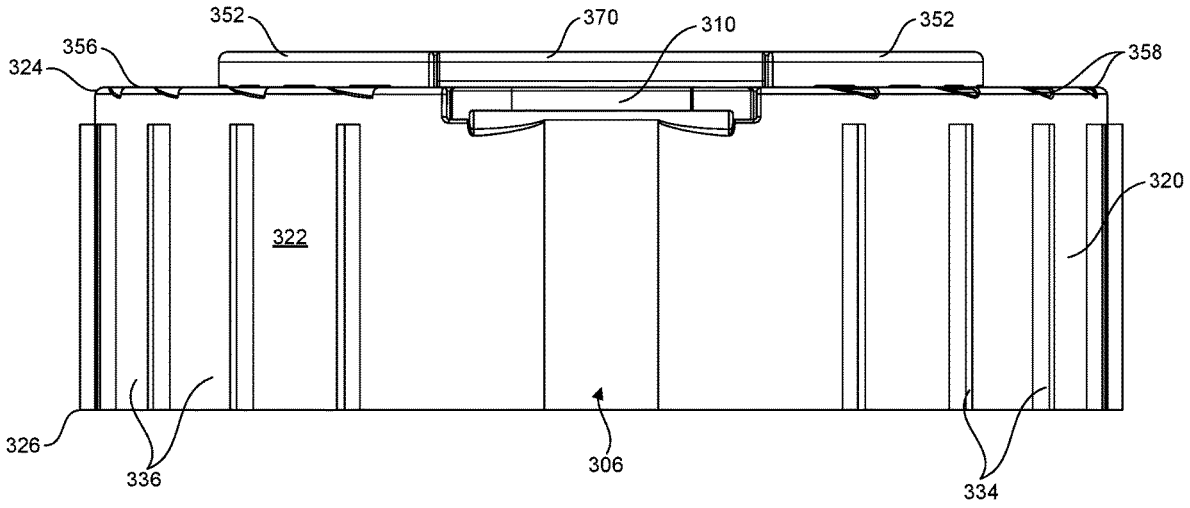
FIG. 3E depicts a rear view of the outer ring illustrated in FIG. 3A.
Figure 3F:
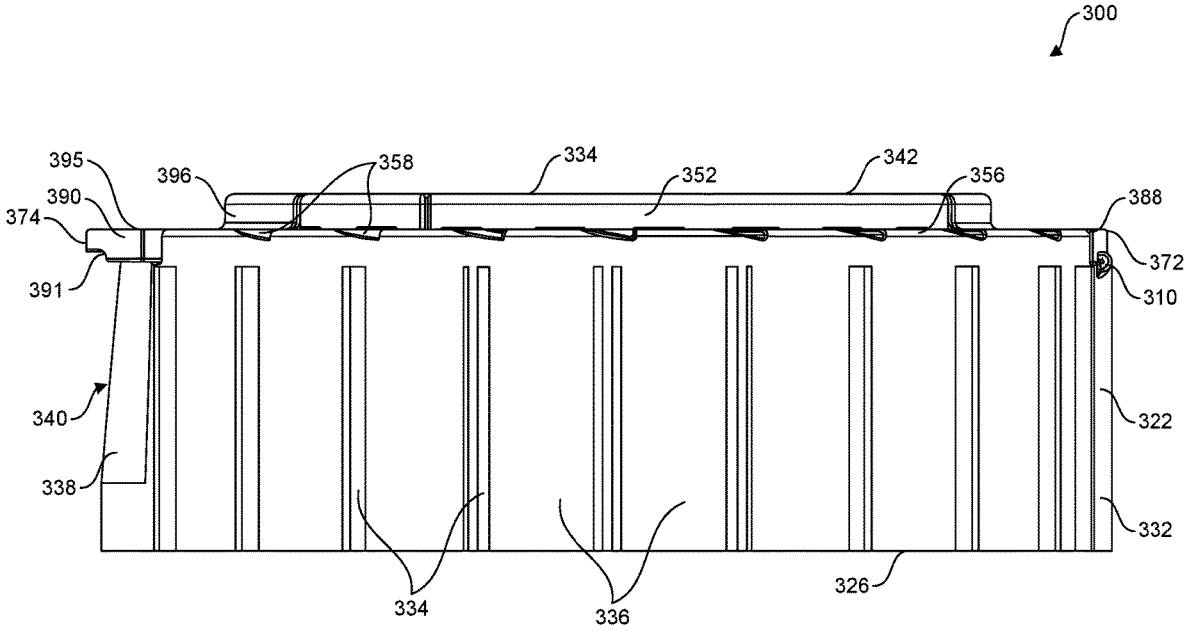
FIG. 3F depicts a right-side view of the outer ring illustrated in FIG. 3A.
Figure 3G:
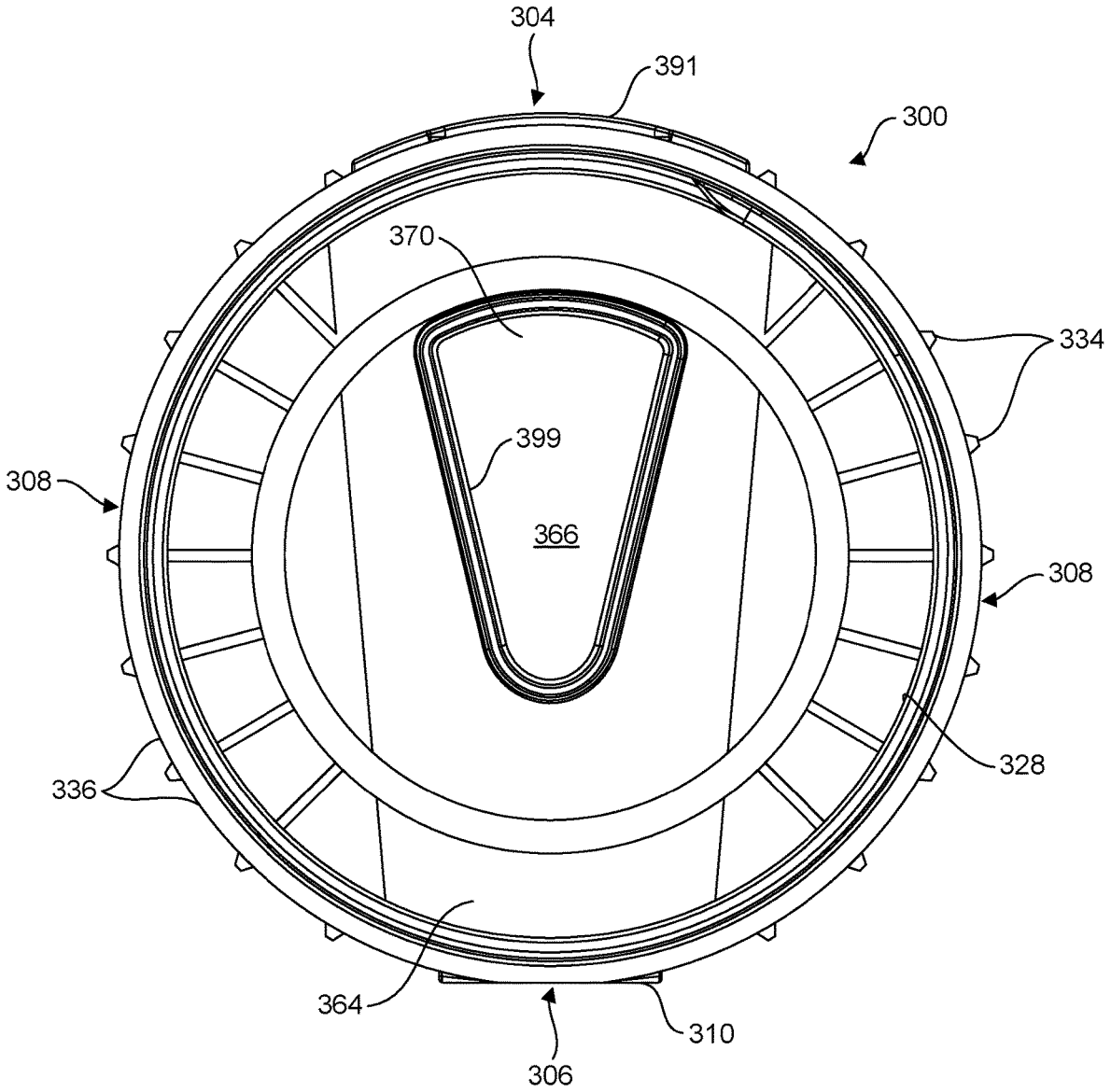
FIG. 3G depicts a bottom view of the outer ring illustrated in FIG. 3A.

Sidewall 322 includes an inner surface 328 (see e.g. FIG. 3G) and an outer surface 332. Inner surface 328 of sidewall 322 may include threads 330 (see e.g FIG. 6A) for removably securing inner cover 300 to neck 240 of container 200 in, for example, a removable manner described in more detail below. As illustrated in FIG. 3D, outer surface 332 may include, for example, a plurality of vertical ribs 334 spaced circumferentially and equidistant from each other around at least a portion of outer surface 332 on opposing side portions 308. Gaps or spaces 336 are formed in between adjacent vertical ribs 334. In one embodiment illustrated in FIG. 3F, a slanted surface portion 338 may be formed in outer surface 332 of sidewall 322 in front portion 304. Slanted surface portion 338 creates an open pocket 340 when aligned with front tab 430 of outer ring 400, as described below, to permit radially inward flexing of front tab 430. In an alternative embodiment, gaps or spaces 336 formed in between adjacent vertical ribs 334 may provide enough room for inward flexing of front tab 430.

As shown in FIG. 3B, lid 370 may be pivotally hinged to base 320 by hinge 310 at a hinge end 372 located proximal to an outer peripheral edge of deck 342 in back portion 306 for pivotal movement between a closed position closing or blocking dispensing opening 366 (see FIG. 3A) and an open position spaced from dispensing opening 366 (see FIG. 3B). Lid 370 may include a base wall 382 lying in a plane perpendicular or transverse to longitudinal axis 302 when closed. Base wall 382 is sized to fit into deck recessed portion 346 formed in top surface 344 of deck 342 in a closed position. In one example, base wall 382 of lid 370 may engage deck recessed portion 346 by, for example, an inference fit or in any other suitable snap-fit or friction manner.

Base wall 382 of lid 370 includes hinge end 372 adjacent hinge 310 and free end 374 diametrically opposed to hinge 310. Base wall 382 may also include a first portion 388 extending from hinge end 372 adjacent hinge 310, a second portion 390 extending from free end 374, and a middle portion 396 extending between first portion 388 and section portion 390. In one example, first portion 388 and section portion 390 may lie in a different plane than middle portion 396. In this example, illustrated in FIG. 3B, deck recessed portion 346 may also include additional recesses 348, 350 formed on top surface 344 for accommodating first and second portions 388, 390 of lid 370 in a closed position. First and section portions 388, 390 of lid 370 are sized to correspond, cooperate and engage corresponding first and second recesses 348, 350, respectively, formed in top surface 344 of deck 342. When in a closed position, top surfaces of first and second portions 388, 390 may lie in the same plane or are flush with curved edge portions 356.

As illustrated in FIG. 3D, second portion 390 of lid 370 may also include, for example, a finger tab portion 391 to aid a user in flipping up lid 370 from a closed position. Finger tab portion 391 may include an indented undersurface 392 having a thin portion 393 surrounded by two thicker portions 394. Thin portion 393 of indented undersurface 392 may be sized to receive at least a portion of a user's finger.

As illustrated in FIG. 3B, middle portion 396 of lid 370 includes a bottom surface 398. An annular wall 399 may extend outwardly from bottom surface 398 of middle portion 396 for sealing engagement with dispensing opening 366 of base 320. When lid 370 is in a closed position (e.g. see FIG. 3A), top surface 397 of middle portion 396 may lie in the same plane or is flush with top surface 442 of peripheral skirt 440 of outer ring 400, as described below and shown in FIG. 4B). Any portion of top surface 378 of lid 370 additionally may include indicating features 380 for assisting and/or instructing a user on opening dispensing cap 100. In one example, top surface 395 of second portion 390 of lid 370 may include an arrow pointing to free end 374 of lid that indicates where a corresponding arrow, indicated on, for example, tab 430 of outer ring 400, needs to align in order to open or flip up lid 370.

FIGS. 4A-4G illustrate one example of an outer ring 400 constructed in accordance with one or more aspects of the present invention. Outer ring 400 includes a longitudinal axis 402, a front portion 404, a back portion 406 diametrically opposed to front portion 404, and diametrically opposed side portions 408. Outer ring 400 also includes a base wall 410 and a peripheral skirt 440 extending radially inward from top edge 412 of base wall 410. Peripheral skirt 440 forms an inner circular central opening 460 that, in one example, includes a diameter sized to fit and allow rotation about longitudinal axis 402 therein of semi-circular surfaces 352 on base deck 342 of inner cover 300 and middle portion 396 of lid 370.

Base wall 410 includes an outer surface 418 and an inner surface 414. In one example, a plurality of gripping members or indentations 420 project radially outward from outer surface 418 to assist a user in grabbing and rotating outer ring 400 about longitudinal axis 402.

In one embodiment, a first opening 422 is formed in at least a portion of base wall 410 and peripheral skirt 440 at front portion 404 and a second opening 424 is formed diametrically opposed to first opening 422 in at least a portion of base wall 410 and peripheral skirt 440 at back portion 406. As illustrated, for example, in FIG. 1A, first opening 422 is sized to accommodate at least a part of second portion 390, including finger tab portion 391, of lid 370 and second opening 424 is sized to accommodate at least a part of first portion 388 of lid 370 and hinge 310 when lid 370 is in an unlocked position in accordance with one or more aspects of the present invention.

First opening 422 is also sized to accommodate at least a portion of a front tab 430. Front tab 430 extends longitudinally upward from bottom edge 413 of base 410 toward a free end 433 within first opening 422 at front portion 404. In one embodiment, front tab 430 is rectangularly shaped and resiliently coupled to base wall 410 adjacent bottom edge 413. During use, front tab 430 may be pushed or flexed radially inwardly towards slanted surface portion 338 or into open pocket 340 when front tab 430 is aligned with slanted surface portion 338 of sidewall 332 of base 320 of inner cover 300, or when front portion 304 of inner cover 300 is aligned with front portion 404 of outer ring 400.

Figure 4A:
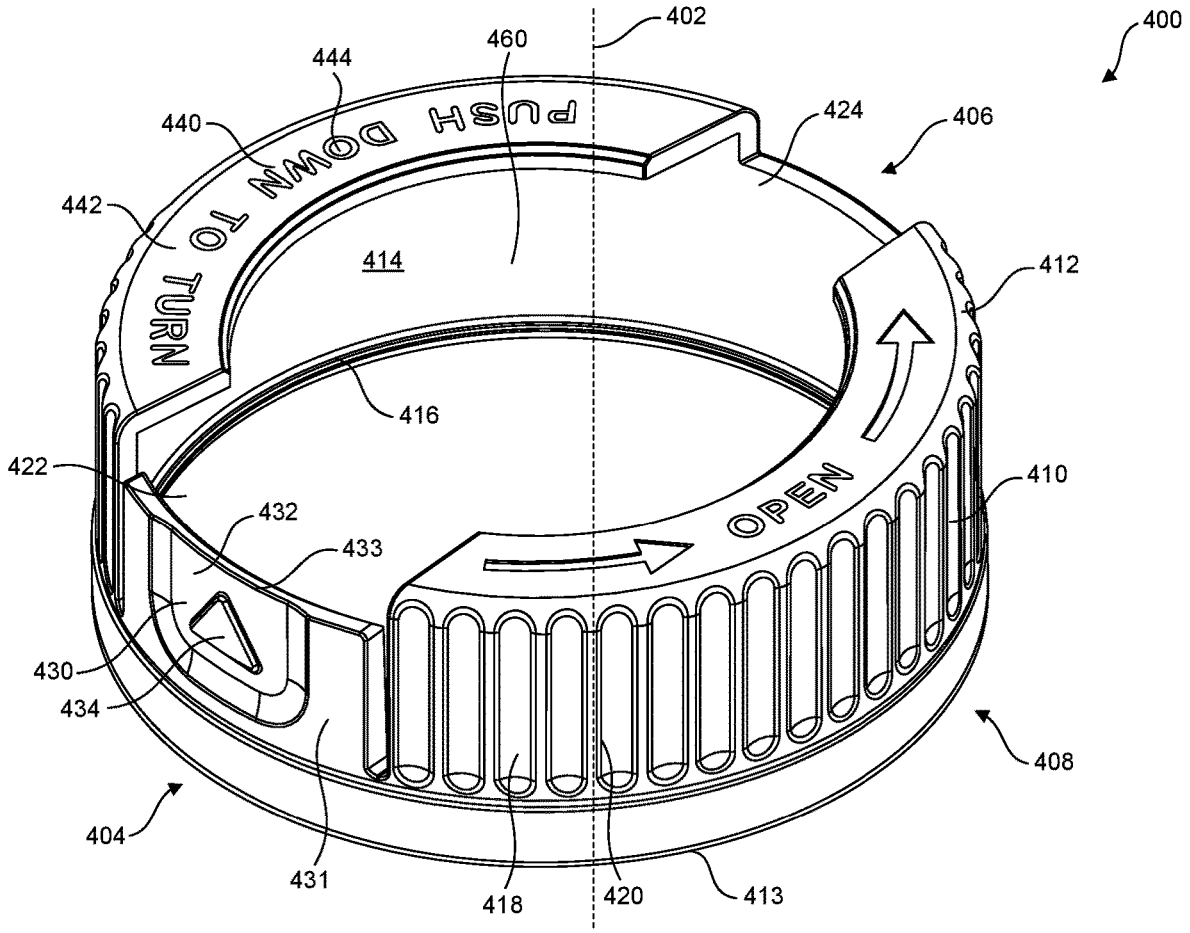
FIG. 4A depicts a perspective view from the top of an outer ring constructed in accordance with one or more aspects of the present invention.

In one example illustrated in FIG. 4A, front tab 430 may include a finger depression 432 formed in outer surface 431. Outer surface 431 of front tab 430 additionally may include indicating features 434 for assisting and/or instructing a user on opening dispensing cap 100. In one example, outer surface 431 of front tab 430 may include an arrow pointing to a free end 433 of front tab 430 that indicates where a corresponding arrow, indicated on top surface 395 of second portion 390 of lid 370, needs to align in order to open or flip up lid 370, as illustrated in FIG. 1B.

Figure 4B:
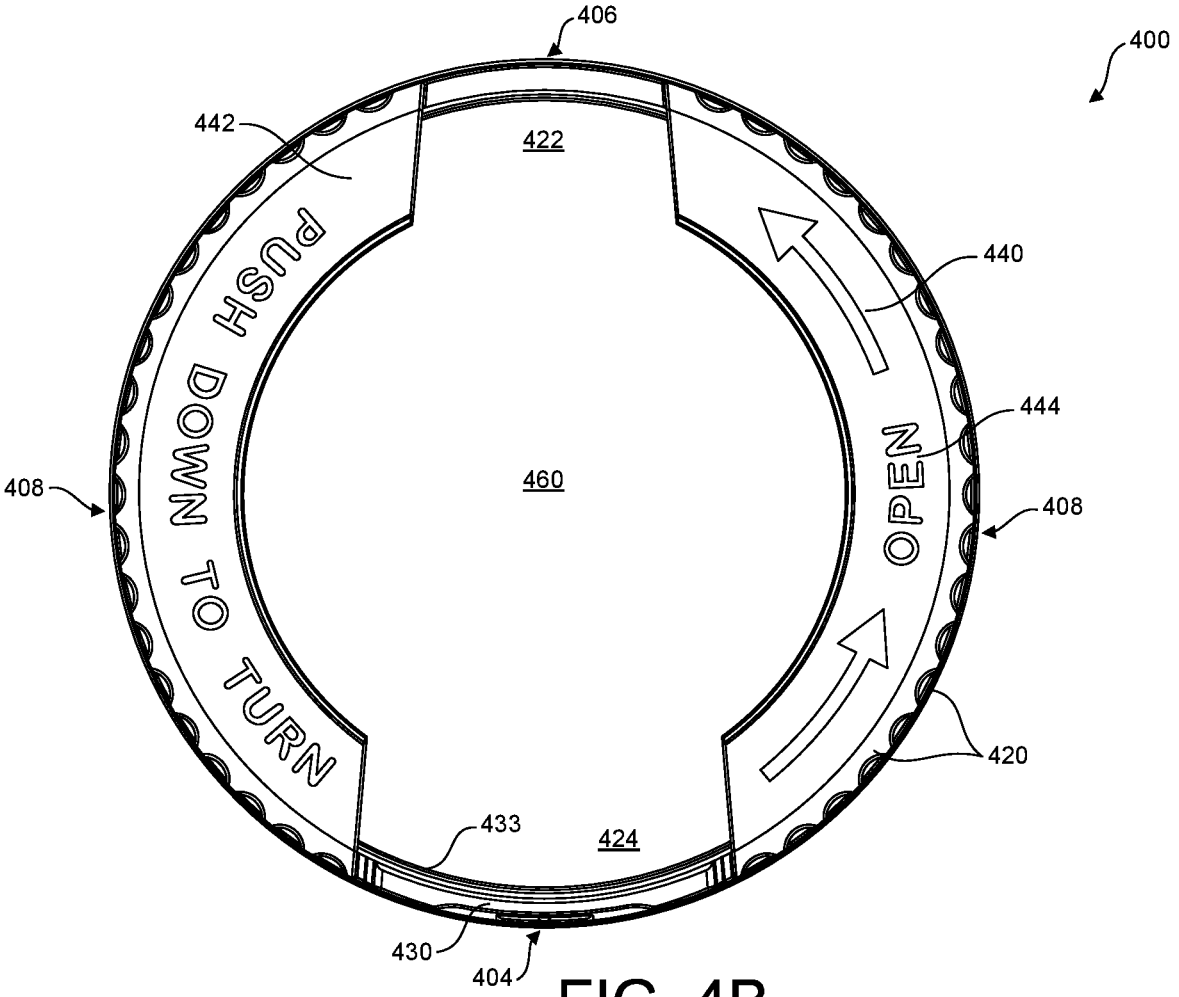
FIG. 4B depicts a top view of the outer ring illustrated in FIG. 4A.
Figure 4C:
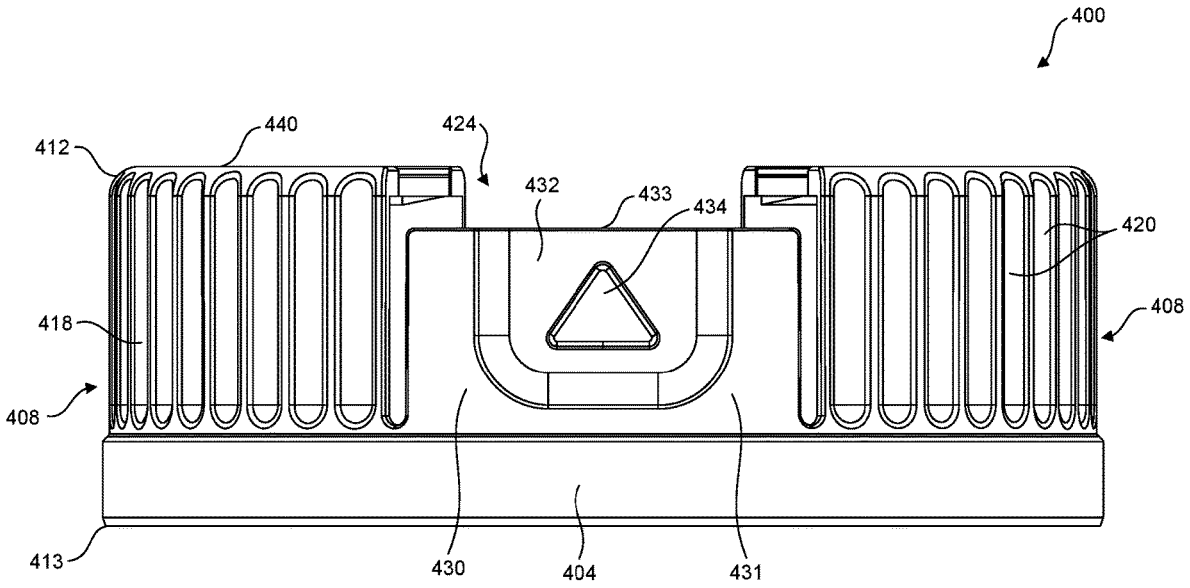
FIG. 4C depicts a front view of the outer ring illustrated in FIG. 4A.
Figure 4D:
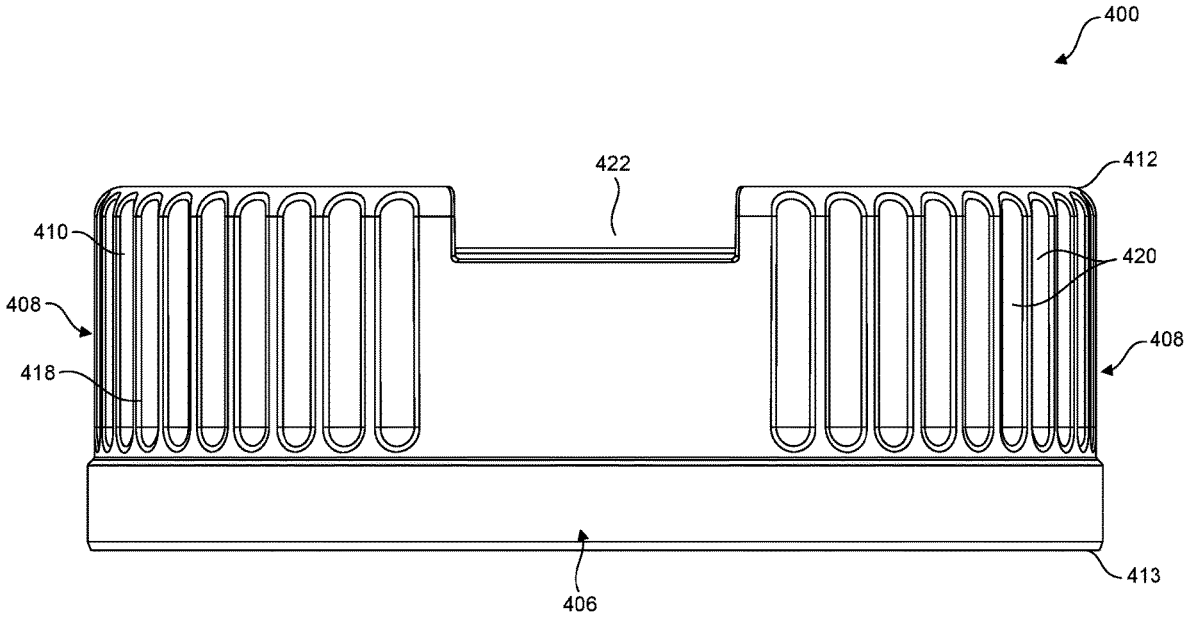
FIG. 4D depicts a rear view of the outer ring illustrated in FIG. 4A.
Figure 4E:
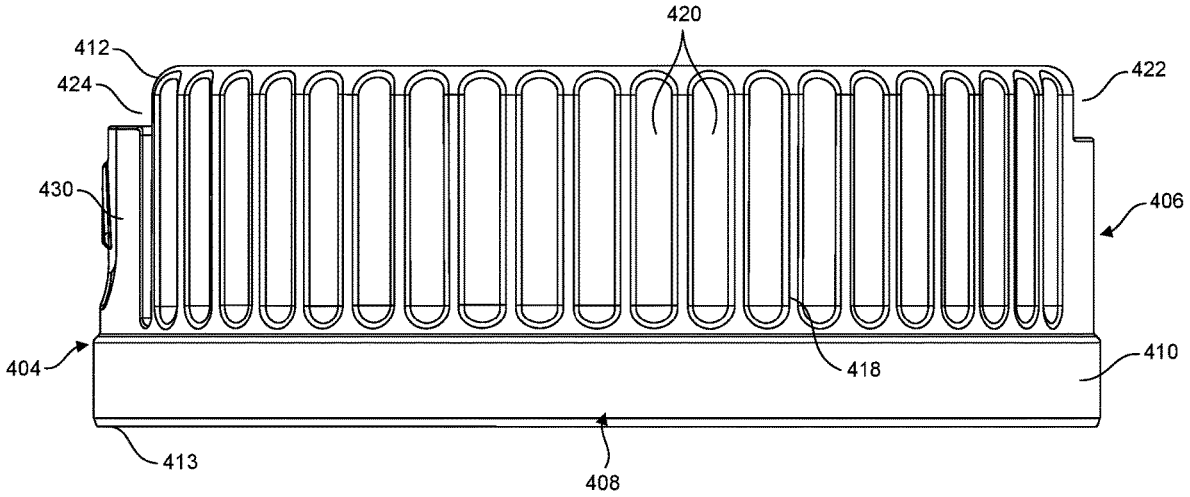
FIG. 4E depicts a right-side view of the outer ring illustrated in FIG. 4A.
Figure 4F:
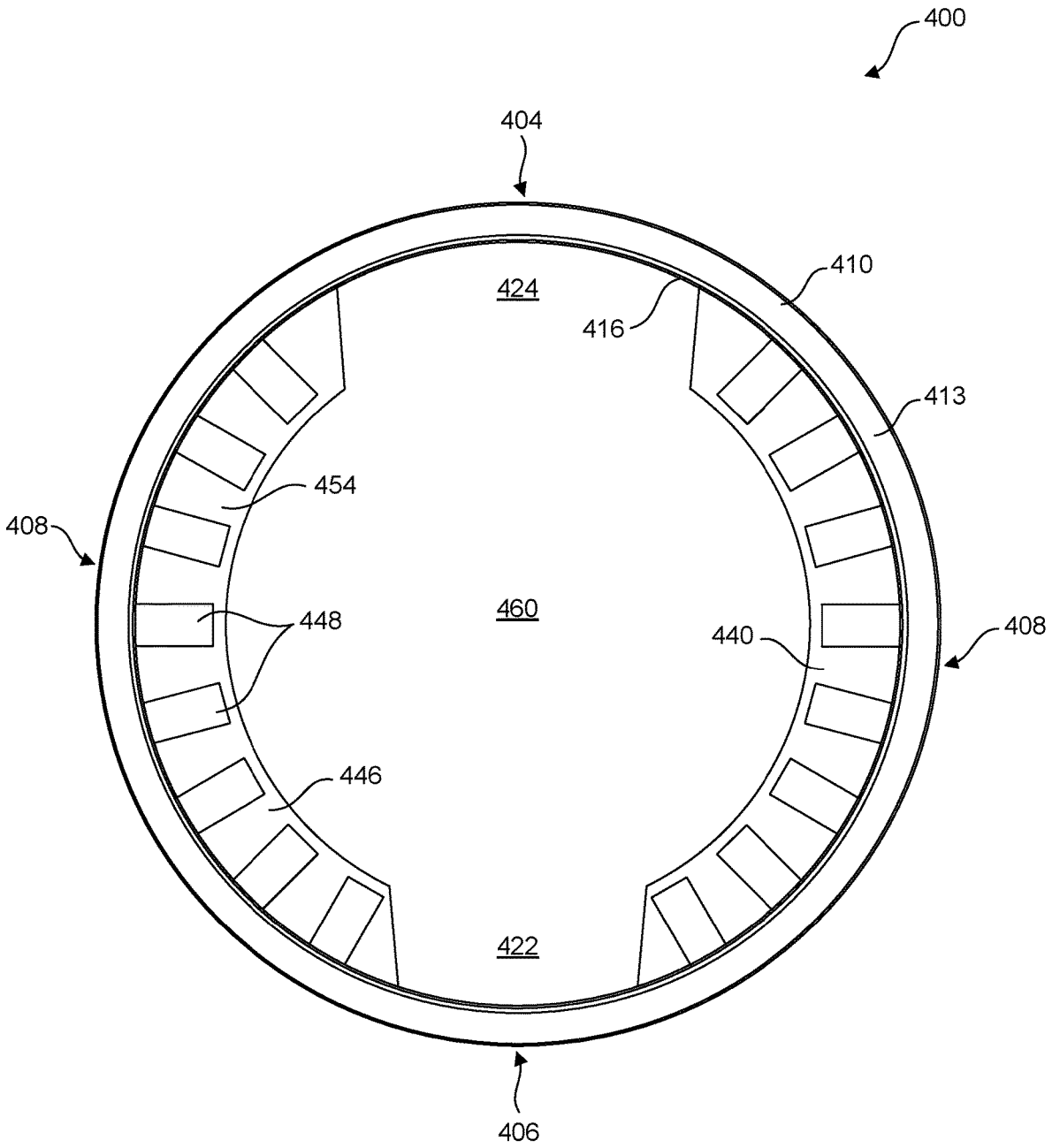
FIG. 4F depicts a bottom view of the outer ring illustrated in FIG. 4A.
Figure 4G:
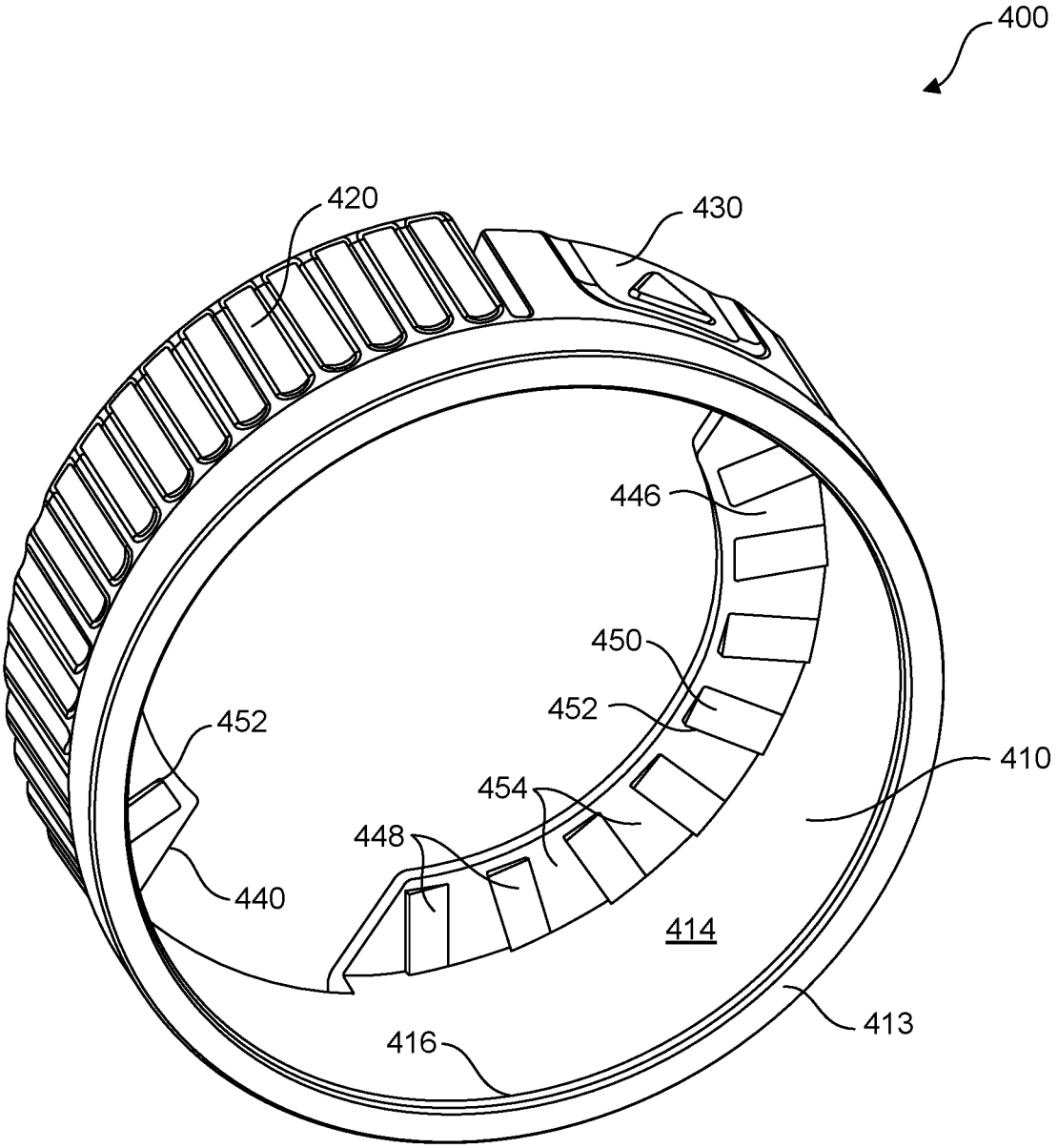
FIG. 4G depicts a perspective view from the bottom of the outer ring illustrated in FIG. 4A.

As illustrated in FIG. 4F-G, inner surface 414 of base wall 410 of outer ring 400 includes a radially inwardly extending circumferential bead or rib 416 near bottom end 413. In the mounted state of outer ring 400 on inner cover 300, rib or bead 416 prevents outer ring 400 from separating from inner cover 300 while still permitting rotational and some longitudinal movement relative to longitudinal axis 402 of outer ring 400 relative to inner cover 300.

As illustrated in FIG. 4B, peripheral skirt 440 may extend circumferentially along at least part of side portions 408 of outer ring 400. Peripheral skirt 440 includes a top surface 442, a bottom surface 446 (see FIGS. 4F and 4G) and a central opening 460. Central opening 460 is adapted, as illustrated in FIGS. 1A and 1B) to surround two semi-circular surfaces 352 of deck 342 and middle portion 396 of lid 370 and allow lid 370 to flip up when dispensing cap 100 is in an unlocked position (see FIG. 1B) in accordance with one or more aspects of the present invention.

Top surface 442 of peripheral skirt 440 may include indicating features 444 for assisting and/or instructing a user on opening dispensing cap 100. In one example, top surface of peripheral skirt may include instructions and directional arrows on operation of dispensing cap 100, as illustrated in FIG. 4B.

As illustrated in FIG. 4F-4G, a plurality of ratchet teeth 448 may project outwardly from bottom surface 446 of peripheral skirt 440. Teeth 448 may be spaced radially equidistant or disposed at intervals in the circumferential direction around and extend axially along bottom surface 446. Each tooth 448 includes an inclined surface 450 and a stop surface 452. In one example, inclined surfaces 450 angle axially towards bottom surface 446 in a counterclockwise direction to create a ramp. Stop surface 452 extends perpendicularly outward from bottom surface 446 and substantially transverse to longitudinal axis 402. A slot or space 454 may be formed by bottom surface 446 between a stop surface 452 of one tooth 448 and an inclined surface 450 of an adjacent tooth 448. During rotation of outer ring 400 relative to inner cover 300, ratchet teeth 448 are sized and configured to interact with depressions 358 formed in semi-circular edge surfaces 356 on top surface 344 of deck 342 of inner cover 300 in accordance with one or more aspects of the present invention, as will be explained in more detail below.

The number, configuration and design of the plurality of teeth 448 and the plurality of depressions 358 may be varied to accommodate the various loads or forces that may be needed or desired therethrough during opening of dispensing cap. Further, the number of teeth and/or the height and length of inclined surface of each tooth and the number of depressions and the depth and length of inclined surface of each depression may be "tuned" or vary greatly depending on the particular load or force desired for a particular application (e.g. desired torque for teeth to overcome or pass over depressions in a particular direction).

Figure 6A:
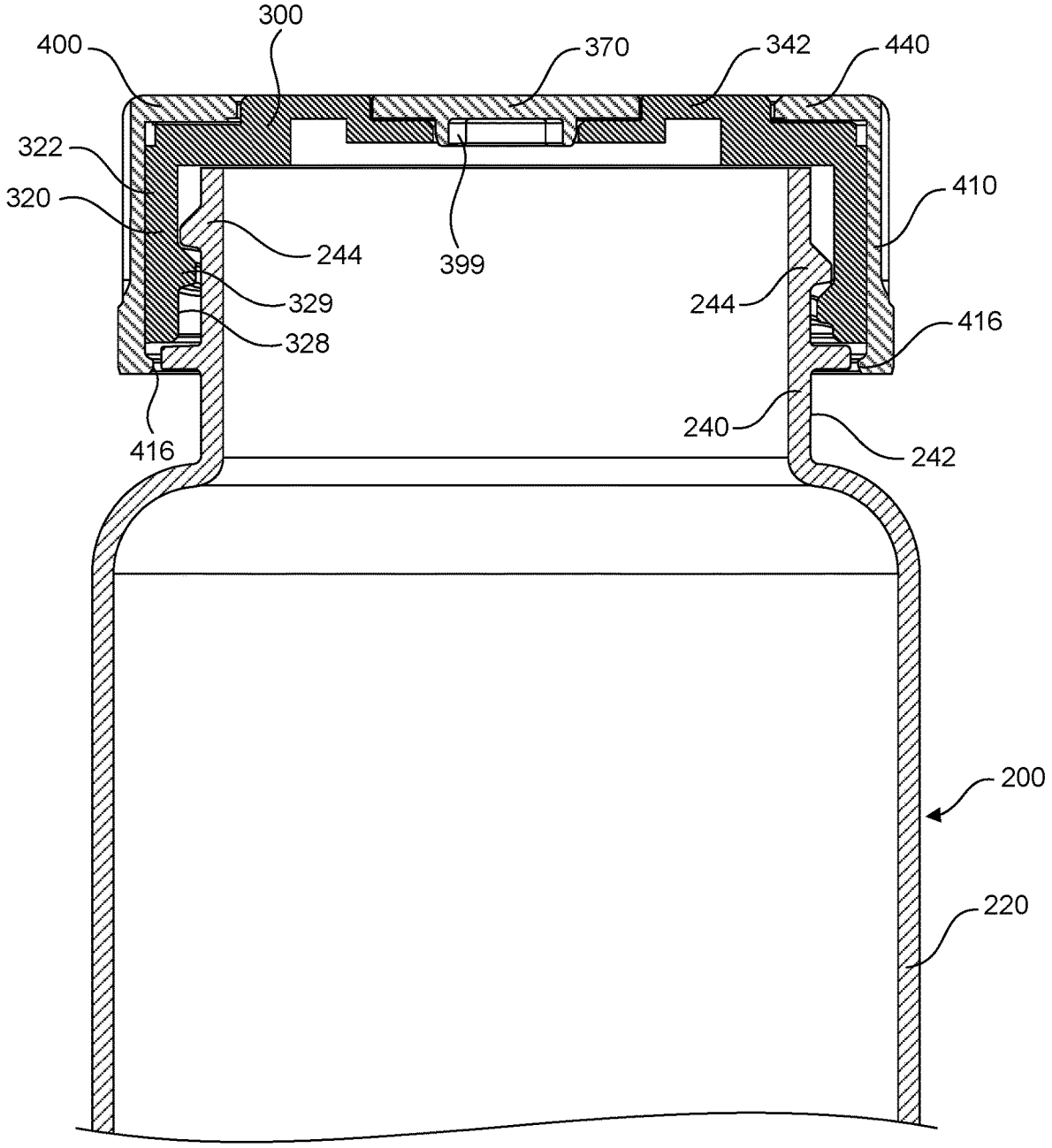
FIG. 6A depicts a cross-sectional view of the dispensing cap illustrated in FIG. 1B taken along the plane 6A-6A.
Figure 6B:
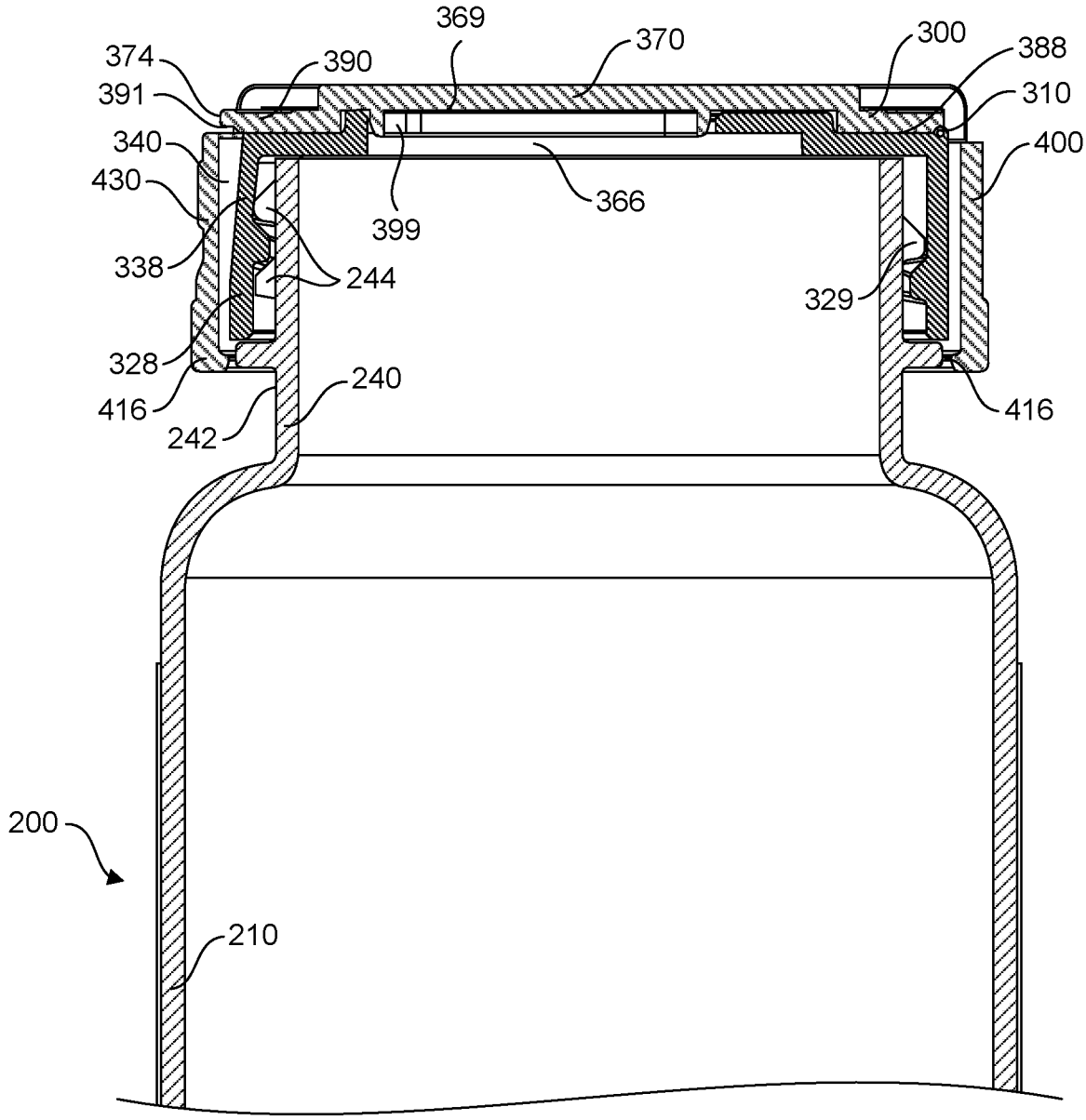
FIG. 6B depicts a cross-sectional view of the dispensing cap illustrated in FIG. 1B taken along the plane 6B-6B.

In assembling dispensing cap 100, inner cover 300 is inserted telescopically into outer ring 400. As illustrated in FIGS. 6A-6B, inner cover 300 completely passes over bead or rib 416 on inner surface 414 of base wall 410 of outer ring 400, while permitting some longitudinal (up and down) movement of inner cover 300 within outer ring 400. Once assembled, outer ring 400 is configured to rotate or spin freely around inner cover 300 when no downward pressure is applied to peripheral skirt 440 by a user. Vertical ribs 334 on outer surface 332 of base sidewall 322 of inner cover 300 separate outer surface 332 from directly contacting inner surface 414 of base wall 410 of outer ring 400. After assembly, inner cover 300 is also configured to move longitudinal (e.g. up and down) relative to longitudinal axis 402 relative to outer ring 400 between bead 416 on inner surface 414 of base wall 410 and engagement with ratchet teeth 448 formed on bottom surface 446 of peripheral skirt 440.

In one example, to secure inner cover 300 to container 200, threads 330 on sidewall 322 of inner cover 300 are received and engage threads 244 formed on outer surface 242 of neck 240 of container 200, as illustrated, for example, in FIGS. 6A and 6B. Once secured to container 200, dispensing cap 100 is effectively non-removable unless certain steps are taken by a user. In other words, dispensing cap 100 is not intended to be removed or opened by a user under normal operation of simple rotation of dispensing cap 100 in a counterclockwise direction.

In operation, dispensing cap 100 may be used as a child resistant dispensing cap to, for example, deter or prevent young children from accessing the contents of the container to which dispensing cap 100 is attached. Inner cover 300 and outer ring 400 of dispensing cap 100 may be manipulated relative to each in several different configurations, including a locked position (see FIG. 1A), an unlocked position (see FIG. 1B) and an open position (see FIG. 1C).

Figure 5A:
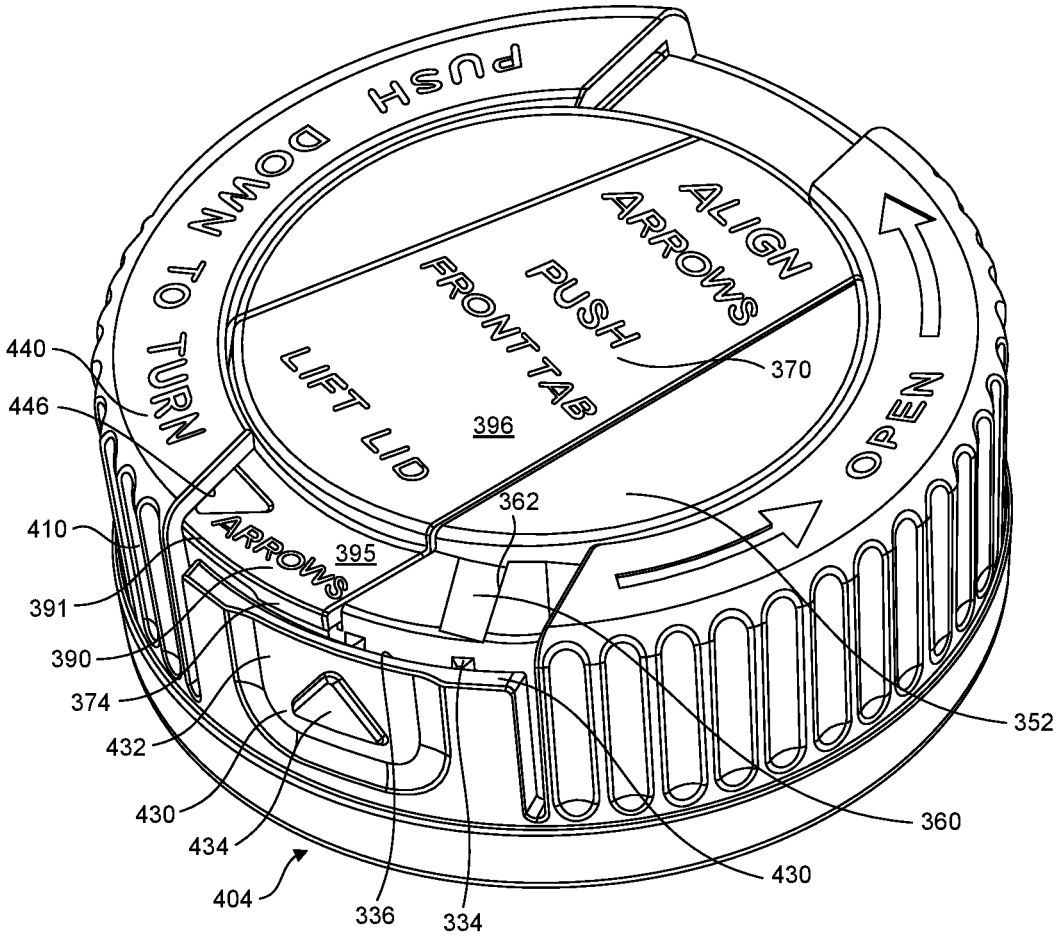
FIG. 5A depicts a perspective view of a dispensing cap constructed in accordance with one or more aspects of the present invention illustrating an inner cover in a locked configuration relative to an outer ring.

In a locked position, illustrated in FIGS. 1A, and 5A, front portion 404 of outer ring 400 is not aligned with front portion 304 of inner cover 300. In other words, second portion 390, including finger tab portion 391, of lid 370 is not aligned within first opening 422 to permit lid 370 to flip up. In a locked position, outer ring 400 is rotated so that at least part of first and second portions 388, 390 of lid 370 of inner cover 300 are covered by at least a part of peripheral skirt 440 of outer ring 400. In this configuration, finger tab portion 391 of second portion 390 of lid 370 passes below bottom surface 446 of peripheral skirt 440 and is inaccessible by a user.

Figure 5B:
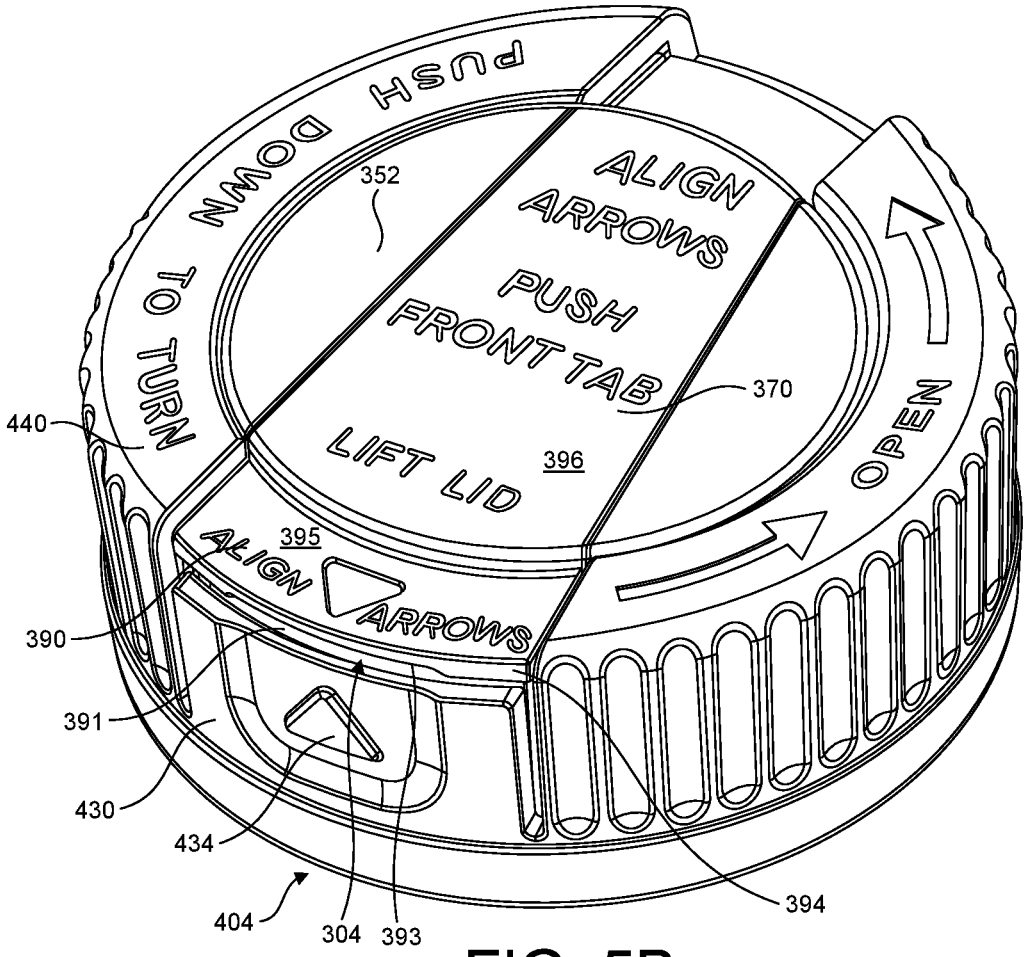
FIG. 5B depicts a perspective view of the dispensing cap of FIG. 5A illustrating the inner cover in an unlocked configuration relative to the outer ring.

In an unlocked position, illustrated in FIGS. 1B and 5B, front portion 404 of outer ring 400 aligns with front portion 304 of inner cover 300. Outer ring 400 is rotated so that first and second portion 388, 390 of lid 370 of inner cover 300 are completely exposed within second and first opening 424, 422, respectively, formed in outer ring 400. In this configuration, no part of top surface 395 of second portion 390 or finger lid portion 391 of lid 370 is covered by peripheral skirt 440. In an unlocked position, front tab 430 aligns with front portion 304 or slanted surface portion 338 formed in base sidewall 322 of inner cover 300. In this configuration, tab 430 may flex radially inward towards slanted surface portion 338 and into open pocket 340.

In an opened position, illustrated in FIG. 1C, lid 370 of inner cover 300 is pivoted upward to expose at least a portion of dispensing opening 366 formed in deck 342. To pivot lid 370 of inner cover 300 upward, a user presses finger depression 432 on outer surface 431 of front tab 430. When pressed by a user, front tab 430 flexes or pivots radially inward into open pocket 340 and towards slanted surface portion 338 of outer surface 332 of base sidewall 322 of inner cover 300. As front tab 430 flexes radially inward, indented underside 392 of finger tab portion 391 of second portion 390 of lid 370 is exposed and accessible by a user. When exposed, a user can apply upward pressure on indented underside 392 of finger tab portion 391 of lid 370 to break the interference fit of lid 370 within recessed portion(s) 346 (including recesses 348 and 350) in deck 342 and flip up lid 370 to an opened position, allowing access to the contents of container 200.

Dispensing cap 100 constructed in accordance with one or more aspects of the present invention includes additional child resistant feature after dispensing cap 100 is secured to container 200. In this aspect, dispensing cap 100 cannot simply be removed from dispensing cap 100 by counter-clockwise rotation. Simple counter-clockwise rotation of outer ring 400 will result in outer ring 400 freely rotating around inner cover 300 without turning or rotation of inner cover 300 relative to neck 240 of container 200. In order to remove dispensing cap 100 from a container 200, a user must apply downward pressure or push down on top surface 442 of peripheral skirt 440 of outer ring 400 in order to engage ratchet teeth 448 projecting from bottom surface 446 of peripheral skirt 440 of outer ring 400 with ratchet depressions 358 formed in curved edge surfaces 356 on top surface 344 of deck 342 of base 320 of inner cover 300. A counterclockwise torque applied to outer ring 400 while pushing down on peripheral skirt 440 will result in stop surfaces 452 of ratchet teeth 448 contacting or digging into stop surfaces 362 of ratchet depressions 358.

In contrast, clockwise torque to outer ring 400 allows ratchet teeth 448 to easily push past or over ratchet depressions 358, resulting in free rotation. In one example, a "clicking" sound may be heard each time ratchet teeth 448 passes over ratchet depressions 358. Alternative child resistant structures and configurations known in the art may be used in place of the ratchet teeth 448 and ratchet depressions 358 discussed above to removably secure a cap to a container.

Other attempts at manufacturing dispensing caps claiming to be child resistant and dispensing require very complex and expensive molds to produce. In contrast, a dispensing cap constructed in accordance with one or more aspects of the present invention was designed to be molded using basic molds that does not require the use of any cam action, multipiece cavities or cores, or collapsible cores required during the molding process. As a result, the investment cost for molds to produce a dispensing cap constructed in accordance with one or more aspect of the present invention is reduced, while maintaining a lower production cost.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements no heretofore described, but which are commensurate with the spirt and scope of the invention. For example, vertical spaced ribs could project from inner surface of base wall of outer ring 400 instead. Or, first end of lid may hinge at a location closer to dispensing opening rather than at a peripheral edge of deck. Or, lid may pivot open by using a flexible strap affixed to deck instead of a hinge. Additional, while various embodiments of the invention have been described, it is to be understood that aspects of the disclosure may include only some of the described embodiments. Accordingly, the invention is not to be seen as limited by the foregoing descriptions, but is only limited by the scope of the appended claims.

This written description uses examples to disclose certain aspects of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A dispensing cap, said dispensing cap comprising:

an inner cover, said inner cover including a base and a lid, the base including a sidewall and a deck extending radially inward from the sidewall, the deck including a dispensing opening, the lid hinged at a hinge end to the deck for pivotal movement between a closed position covering the dispensing opening and an open position spaced from the dispensing opening, the lid including a finger tab portion end opposed to the hinge end, the finger tab portion end including an underside surface;

an outer ring, said inner cover coaxially nested and retained within said outer ring, said outer ring including a sidewall and a peripheral skirt extending radially inward from the sidewall, the peripheral skirt at least partially covering a portion of the deck of said inner cover, the sidewall of said inner cover facing the side wall of said outer ring, the sidewall of said outer ring including an opening, a front tab resiliently extending from a peripheral of the sidewall in the opening, the front tab being directly manually engageable by a user from a radial direction external to said outer ring to pivot the front tab radially inward towards the sidewall of the base of said inner cover, and said outer ring rotatable around said inner cover between an unlocked position when the front tab of said outer ring aligns with the finger tab portion end of said inner cover and a locked position when the finger tab portion of said inner cover does not align with the front tab of said outer ring, wherein the lid is permitted to pivot to the open position when said outer ring and said inner cover are in the unlocked position and front tab pivots radially inward towards the sidewall of the base of said inner cover exposing the underside surface of the finger tab portion end of the lid of said inner cover, and wherein the lid is prevented from pivoting to the open position when said outer ring and said inner cover are in the locked position.

2. The dispensing cap of claim 1, wherein at least a portion of finger tab portion end of the lid is covered by at least a portion of the peripheral skirt of said outer ring when said outer ring and said inner cover are in the locked position.

3. The dispensing cap of claim 1, wherein a plurality of ribs projects radially outward from the sidewall of the base of said inner cover towards the sidewall of said outer ring.

4. The dispensing cap of claim 1, wherein an open pocket is formed between the front tab of said outer ring and the sidewall of the base of said inner cover when the front tab of said outer ring aligns with the finger tab portion end of said inner covering.

5. The dispensing cap of claim 4, wherein the sidewall of the base of said inner cover includes an outer surface that slants radially inward to form the open pocket.

6. The dispensing cap of claim 1, wherein the finger tab portion end is diametrically opposed to the hinge end.

7. The dispensing cap of claim 1, wherein the lid is resiliently held by an interference fit to the deck in the closed position.

8. The dispensing cap of claim 1, wherein said dispensing cap is removably mounted to a container by applying downward pressure on said outer ring to engage said inner cover.

9. The dispensing cap of claim 8, wherein a plurality of ratchet teeth project from a bottom surface of the peripheral skirt of said outer ring, wherein a plurality of ratchet depressions are formed on an upper surface of the deck of the base of said inner cover, wherein downward pressure on said outer ring engages at least one of the plurality of ratchet teeth with at least one of the plurality of ratchet depressions, wherein counterclockwise rotation of said outer ring while applying downward pressure will cause said inner cover to rotate in unison with said outer ring to remove said dispensing cap from the container.

10. The dispensing cap of claim 1, wherein the sidewall of said outer ring includes a top edge and a bottom end, wherein the peripheral skirt extends radially inward from the top edge, wherein an inner surface of the sidewall includes a circumferential rib proximal to the bottom end, wherein the circumferential rib and the peripheral skirt retain said inner cover within said outer ring.

11. The dispensing cap of claim 1, wherein the front tab includes an inner surface facing the sidewall of the base of said inner cover and an outer surface opposite the inner surface, wherein the outer surface includes an indicator for assisting a user in aligning the front tab of said outer ring with the finger tab portion end of said inner cover.

12. The dispensing cap of claim 11, wherein the lid includes an outer surface opposite the underside surface of the finger tab portion, wherein the outer surface of the lid includes an indicator for assisting a user in aligning the front tab of said outer ring with the finger tab portion end of said inner cover, wherein when the indicator on the outer surface of the lid aligns with the indicator on the outer surface of the front tab, the dispensing cap is in the unlocked position.

13. The dispensing cap of claim 12, wherein the indicators on the outer surface of the lid and the outer surface of the front tab are arrows.

14. A dispensing cap, said dispensing cap comprising:

an inner cover, said inner cover including a base and a lid, the base including a sidewall and a deck extending radially inward from the sidewall, the sidewall including a front portion, a back portion opposed to the front portion and side portions extending between the front portion and the back portion, the deck including a dispensing opening, curved edge surfaces extending along the side portions of the sidewall, a recessed portion extending from the front portion of the sidewall to the back portion of the side wall, and semi-circular surfaces respectively between the curved edge surfaces and the recessed portion, the lid hinged at a hinge end to the deck near the back portion of the sidewall for pivotal movement between a closed position covering the dispensing opening and an open position spaced from the dispensing opening, the lid including a finger tab portion end opposed to the hinge end, the finger tab portion end near the front portion of the sidewall in the closed position, the finger tab portion including an underside surface;

an outer ring, said inner cover coaxially nested and retained within said outer ring, said outer ring including a sidewall and a peripheral skirt, the sidewall including a front portion, a back portion opposed to the front portion and side portions extending between the front portion and the back portion, the peripheral skirt extending radially inward from the sidewall, the peripheral skirt forming a central opening, wherein the semi-circular surfaces and at least a portion of the lid are disposed within the central opening, the peripheral skirt at least partially covering the curved edge surfaces of the deck of said inner cover, the sidewall of said inner cover facing the side wall of said outer ring, the sidewall of said outer ring including a front opening at the front portion of the sidewall of said outer ring and a back opening near the back portion of the sidewall of said outer ring, a front tab resiliently extending from a peripheral of the sidewall in the front opening, the hinge end of the lid disposed in the second opening, the front tab being directly manually engageable by a user from a radial direction external to said outer ring to pivot the front tab radially inward towards the sidewall of the base of said inner cover, and said outer ring rotatable around said inner cover between an unlocked position when the front tab of said outer ring aligns with the finger tab portion end of said inner cover and a locked position when the finger tab portion of said inner cover does not align with the front tab of said outer ring, wherein the lid is permitted to pivot to the open position when said outer ring and said inner cover are in the unlocked position and the front tab pivots radially inward towards the sidewall of the base of said inner cover exposing the underside surface of the finger tab portion end of the lid of said inner cover, and wherein the lid is prevented from pivoting to the open position when said outer ring and said inner cover are in the locked position.

15. The dispensing cap of claim 14, wherein the finger tab portion end of the lid of said inner cover is at least partially covered by the peripheral skirt of said outer ring in the locked position.

16. The dispensing cap of claim 1, wherein the finger tab portion end of the lid of said inner cover is at least partially covered by the peripheral skirt of said outer ring in the locked position.

* * * * *